US006474782B1

(12) United States Patent
Furukawa

(10) Patent No.: US 6,474,782 B1
(45) Date of Patent: Nov. 5, 2002

(54) PRINTHEAD AND PRINTING APPARATUS USING THE SAME

(75) Inventor: Tatsuo Furukawa, Zama (JP)

(73) Assignee: Canon Kabushiki Kaisha, Tokyo (JP)

( * ) Notice: Subject to any disclaimer, the term of this patent is extended or adjusted under 35 U.S.C. 154(b) by 15 days.

(21) Appl. No.: 09/640,722

(22) Filed: Aug. 18, 2000

(30) Foreign Application Priority Data

Aug. 24, 1999 (JP) ..... 11-237526

(51) Int. Cl.[7] ..... B41J 2/14; B41J 2/16; B41J 2/05

(52) U.S. Cl. ..... 347/50; 347/58

(58) Field of Search ..... 347/37, 50, 58, 347/59

(56) References Cited

U.S. PATENT DOCUMENTS

| | | | | |
|---|---|---|---|---|
| 4,313,124 A | | 1/1982 | Hara | 347/57 |
| 4,345,262 A | | 8/1982 | Shirato et al. | 347/10 |
| 4,459,600 A | | 7/1984 | Sato et al. | 347/47 |
| 4,463,359 A | | 7/1984 | Ayata et al. | 347/56 |
| 4,558,333 A | | 12/1985 | Sugitani et al. | 347/65 |
| 4,723,129 A | | 2/1988 | Endo et al. | 347/56 |
| 4,740,796 A | | 4/1988 | Endo et al. | 347/56 |
| 5,453,713 A | | 9/1995 | Partovi et al. | 327/565 |
| 5,745,130 A | | 4/1998 | Becerra et al. | 347/14 |
| 5,877,784 A | | 3/1999 | Maru et al. | 347/12 |
| 6,022,094 A | * | 2/2000 | Gibson et al. | 347/19 |

FOREIGN PATENT DOCUMENTS

| | | |
|---|---|---|
| CA | 2075097 | 2/1993 |
| EP | 0 641 655 | 3/1995 |
| EP | 0 650 837 | 5/1995 |
| JP | 59-123670 | 7/1984 |
| JP | 59-138461 | 8/1984 |
| JP | 1-94646 | 4/1989 |
| JP | 1-220467 | 9/1989 |
| JP | 5-185594 | 7/1993 |

* cited by examiner

*Primary Examiner*—Thinh Nguyen
(74) *Attorney, Agent, or Firm*—Fitzpatrick, Cella, Harper & Scinto

(57) ABSTRACT

Disclosed is a printhead in which mixture of noise between the power supplies of analog and digital systems is suppressed, and a circuit for processing a small analog signal, e.g., a temperature sensing circuit, does not decrease in precision even for a high clock frequency. In the printhead including an element board on which a digital circuit including a driver and heater array and an analog circuit including a temperature sensing block are formed by a semiconductor process, and an electrical circuit board having a plurality of external input terminals for inputting/outputting signals from/to the element board, the power supply of the digital circuit and the power supply of the analog circuit are arranged apart from each other on the element board, and commonly connected to one terminal of a capacitor provided on the electrical circuit board with the other terminal grounded on the electrical circuit board.

12 Claims, 16 Drawing Sheets

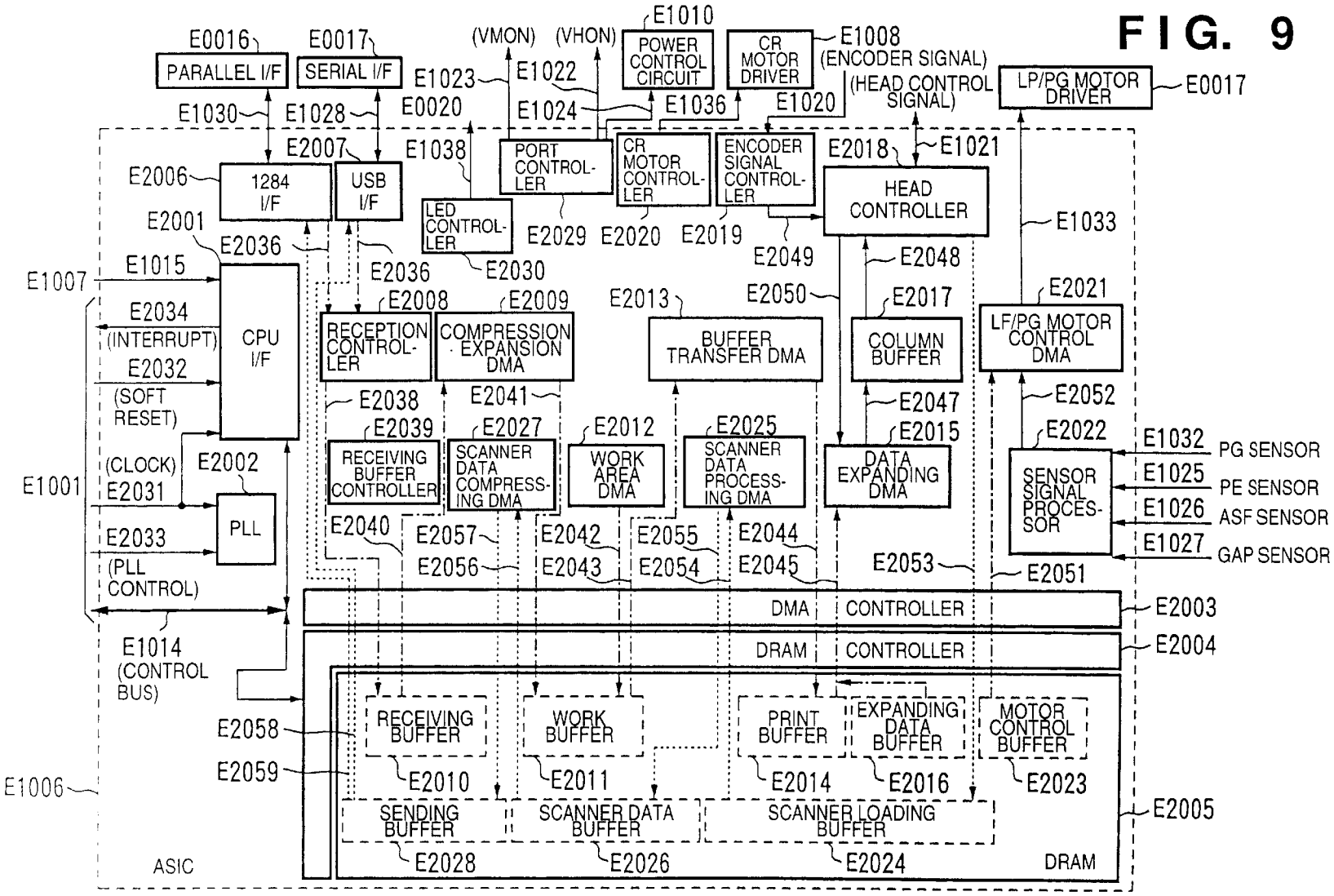
FIG. 9
LP/PG MOTOR DRIVER
E0017
E1033
E2021
LF/PG MOTOR CONTROL DMA
E2052
E2022
SENSOR SIGNAL PROCES-SOR
E2051
E1032 PG SENSOR
E1025 PE SENSOR
E1026 ASF SENSOR
E1027 GAP SENSOR
E2003
E2004
E2005
DRAM
MOTOR CONTROL BUFFER
E2023
E1021
HEAD CONTROLLER
E2018
E2048
E2017
COLUMN BUFFER
E2047
E2015
DATA EXPANDING DMA
E2053
CONTROLLER
CONTROLLER
EXPANDING DATA BUFFER
E2016
E1008 (ENCODER SIGNAL)
(HEAD CONTROL SIGNAL)
CR MOTOR DRIVER
E1020
ENCODER SIGNAL CONTROL-LER
E2049
E2050
BUFFER TRANSFER DMA
E2025
SCANNER DATA PROCESS-ING DMA
E2044
E2045
DMA
DRAM
PRINT BUFFER
E2014
SCANNER LOADING BUFFER
E2024
E1010
POWER CONTROL CIRCUIT
E1036
CR MOTOR CONTROL-LER
E2019
E2020
E2013
E2012
WORK AREA DMA
E2055
E2054
E2026
(VHON)
E1022
E1024
PORT CONTROL-LER
E2029
E2030
E2009
COMPRESSION EXPANSION DMA
E2041
E2027
SCANNER DATA COMPRESS-ING DMA
E2042
E2043
WORK BUFFER
E2011
SCANNER DATA BUFFER
(VMON)
E1023
E1038
LED CONTROL-LER
E2057
E2056
E0017
SERIAL I/F
E0020
E2008
E2036
RECEPTION CONTROL-LER
E2038
E2039
RECEIVING BUFFER CONTROLLER
E2040
RECEIVING BUFFER
E2010
SENDING BUFFER
E2028
E1028
USB I/F
E2007
E0016
PARALLEL I/F
E1030
1284 I/F
E2006
E2001
E2036
CPU I/F
E2002
PLL
E2058
E2059
E1015
E2034
(INTERRUPT)
E2032
(SOFT RESET)
(CLOCK)
E2031
E2033
(PLL CONTROL)
E1014 (CONTROL BUS)
ASIC
E1007
E1001
E1006

CONNECT APPARATUS TO POWER SUPPLY
FIRST INITIALIZATION
S1
1
S2
NO
POWER KEY ON INPUT CHECK?
YES
SECOND INITIALIZATION
S3
2
S4
WAIT FOR EVENT?
PRINT COMMAND RECEPTION
POWER KEY OFF INPUT
ANOTHER EVENT INPUT
S10
S11
S5
COMMAND ANALYSIS
PRINTER TERMINATION PROCESS
EVENT PROCESSING
S6
PAPER FEED
1
2
S7
PRINT
S8
PAPER DELIVERY
S9
NO
ARE ALL PAGES COMPLETELY PRINTED?
YES
2

PRINTHEAD AND PRINTING APPARATUS USING THE SAME

FIELD OF THE INVENTION

The present invention relates to a printhead and a printing apparatus using the same and, more particularly, to a printhead having an element board or a substrate on which a digital circuit including a printing element and a driving means for driving the printing element in accordance with input printing data, and an analog circuit including a sensing means for sensing information about printing (information about the board/substrate state) are formed by a semiconductor process, and a printing apparatus using the same.

Note that the present invention is applicable not only to a general printing apparatus but also to a copying machine, a facsimile apparatus having a communication system, a word processor having a printing unit, and an industrial printing apparatus combined with various processors.

BACKGROUND OF THE INVENTION

In a conventional inkjet printing apparatus using thermal energy, the electrothermal transducer (heater) of a mounted printhead, and a driving circuit for the electrothermal transducer are formed on the same board using a semiconductor process technique, as disclosed in, e.g., Japanese Patent Laid-Open No. 5-185594. It is also proposed to form, on the same board, elements for sensing the state of this board, e.g., the distribution state of the board temperature or resistance value or variations in the characteristics of the driving circuit.

Outputs from these sensing elements are often analog signals, and a signal processed in a signal processing circuit for feeding back a driving signal using these outputs is often an analog signal. Such an analog signal is readily influenced by noise. To solve this problem, Japanese Patent Application No. 11-198095 discloses an arrangement of converting analog signals into digital values by an analog-to-digital conversion means formed on the same board, and supplying the digital values to the signal processing circuit to optimize the driving signal.

In any case, a circuit block for processing an analog signal exists on the board. A circuit for sensing a small signal level or detecting a signal at a high resolution may be mounted. On the board on which the heaters and driving circuit used for the printhead are integrally formed, circuit blocks which operate by digital signals, such as a shift register for temporarily storing image data to be printed, a latch circuit for latching the image data, and a decoder circuit for sequentially selecting heaters to be driven are also formed by the same process. These digital circuits receive clock signal pulses serving as the operation references.

More specifically, an analog signal processing circuit for sensing the board state and a digital signal processing circuit for driving the heater in accordance with image data exist on the same board of the printhead. The printing speed required for a printhead and printing apparatus is increasing year by year. Along with this, the image data transfer clock frequency is also increasing. As the printing speed increases, the driving frequency of a heater for generating heat for performing printing is increasing. This increases the heat generation amount per unit time, and increases the temperature of the entire board. Thus, the temperature rise of the board must be sensed to feed back driving operation at higher precision.

As the clock frequency increases, the analog circuit-system for sensing the temperature at high precision may malfunction under the influence of radiation noise or line noise generated from the digital circuit system. To prevent this, there has conventionally been proposed an arrangement of applying the voltages of analog and digital systems from separate power supplies to suppress mixture of noise. In this case, the voltages of the analog and digital systems are applied to circuits on a board via different power supply lines and power supply terminals.

In this prior art, however, two power supply paths exist at positions close to the printhead. If the power supply line is short, noise can be greatly reduced. To the contrary, if the power supply line extending from the power supply to a power supply terminal formed on the printhead is long, radiation noise or coupling noise generated by a clock pulse supplied to the digital system is mixed in the signal of the analog system circuit owing to the inductance component of the power supply line or the capacitance component between the power supply line and another line. As a result, the analog system decreases in precision or malfunctions.

The separate power supplies must be arranged for the analog and digital circuit systems when the voltages of the two systems are different. When, however, these voltages are the same (e.g., 5 V), the same voltage is repetitively applied from the separate power supplies.

SUMMARY OF THE INVENTION

It is an object of the present invention to provide a printhead in which mixture of noise between the power supplies of analog and digital systems is suppressed even when a power supply line, such as a flexible cable or printed substrate wire, is long, and a circuit for processing a small analog signal, e.g., a temperature sensing circuit, does not decrease in precision even for a high clock frequency, and a printing apparatus using the same.

It is another object of the present invention to provide a printhead capable of suppressing mixture of noise in the circuit systems while sharing a power supply when the power supply voltages of the analog and digital systems are the same, and a printing apparatus using the same.

To achieve the above objects, a printhead according to the present invention comprises an element substrate on which a digital circuit including a printing element and driving means for driving the printing element in accordance with input printing data, and an analog circuit including sensing means for sensing information about a state of the element substrate are formed by a semiconductor process, and an electrical circuit substrate which is connected to the element substrate, and has a plurality of external input terminals for inputting/outputting signals from/to the element substrate, wherein a power supply of the digital circuit and a power supply of the analog circuit are commonly connected to the other terminal of a capacitor having one terminal grounded on the electrical circuit substrate.

The above objects can also be achieved by a printing apparatus for performing printing using the above printhead.

More specifically, in a printhead in which a digital circuit including a printing element and driving means for driving the printing element in accordance with input printing data, and an analog circuit including sensing means for sensing information about printing are formed on the same element substrate by a semiconductor process, and which comprises an electrical circuit substrate having a plurality of external input terminals for inputting/outputting signals from/to the element substrate, the power supplies of the digital and analog circuits are commonly connected to the other terminal of the capacitor having one terminal grounded on the electrical circuit substrate.

This arrangement can avoid mixture of noise of the digital circuit in the analog circuit, and decrease the noise level.

The operation precision of the analog circuit such as a substrate temperature sensing circuit or heater resistance value monitoring circuit increases. The printing quality of the printhead can increase, and malfunction can be prevented, resulting in high performance.

In this case, the power supplies of the digital and analog circuits are arranged apart enough not to transmit the influence of noise, which can suppress mixture of noise generated inside the element substrate.

The digital circuit preferably includes a shift register for temporarily storing the printing data and a latch for latching the data stored in the shift register.

The analog circuit preferably includes either one of means for sensing a temperature outside the element substrate and means for monitoring a heater resistance value.

The capacitor preferably has a capacitance of 0.1 $\mu$F to 10 $\mu$F.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 9 is a block diagram showing the internal arrangement of an ASIC shown in FIG. 8;

DETAILED DESCRIPTION OF THE PREFERRED EMBODIMENTS

Embodiments according to a printing apparatus of the present invention will be described below with reference to the accompanying drawings.

In the embodiments to be explained below, a printing apparatus using an inkjet printing system will be described by taking a printer as an example.

In this specification, "print" means not only to form significant information such as characters and graphics but also to form, e.g., images, figures, and patterns on printing media in a broad sense, regardless of whether the information formed is significant or insignificant or whether the information formed is visualized so that a human can visually perceive it, or to process printing media.

"Printing media" are any media capable of receiving ink, such as cloth, plastic films, metal plates, glass, ceramics, wood, and leather, as well as paper sheets used in common printing apparatuses.

Furthermore, "ink" (to be also referred to as a "liquid" hereinafter) should be broadly interpreted like the definition of "print" described above. That is, ink is a liquid which is applied onto a printing medium and thereby can be used to form images, figures, and patterns, to process the printing medium, or to process ink (e.g., to solidify or insolubilize a colorant in ink applied to a printing medium).

[Apparatus Main Body]

Figure 1:
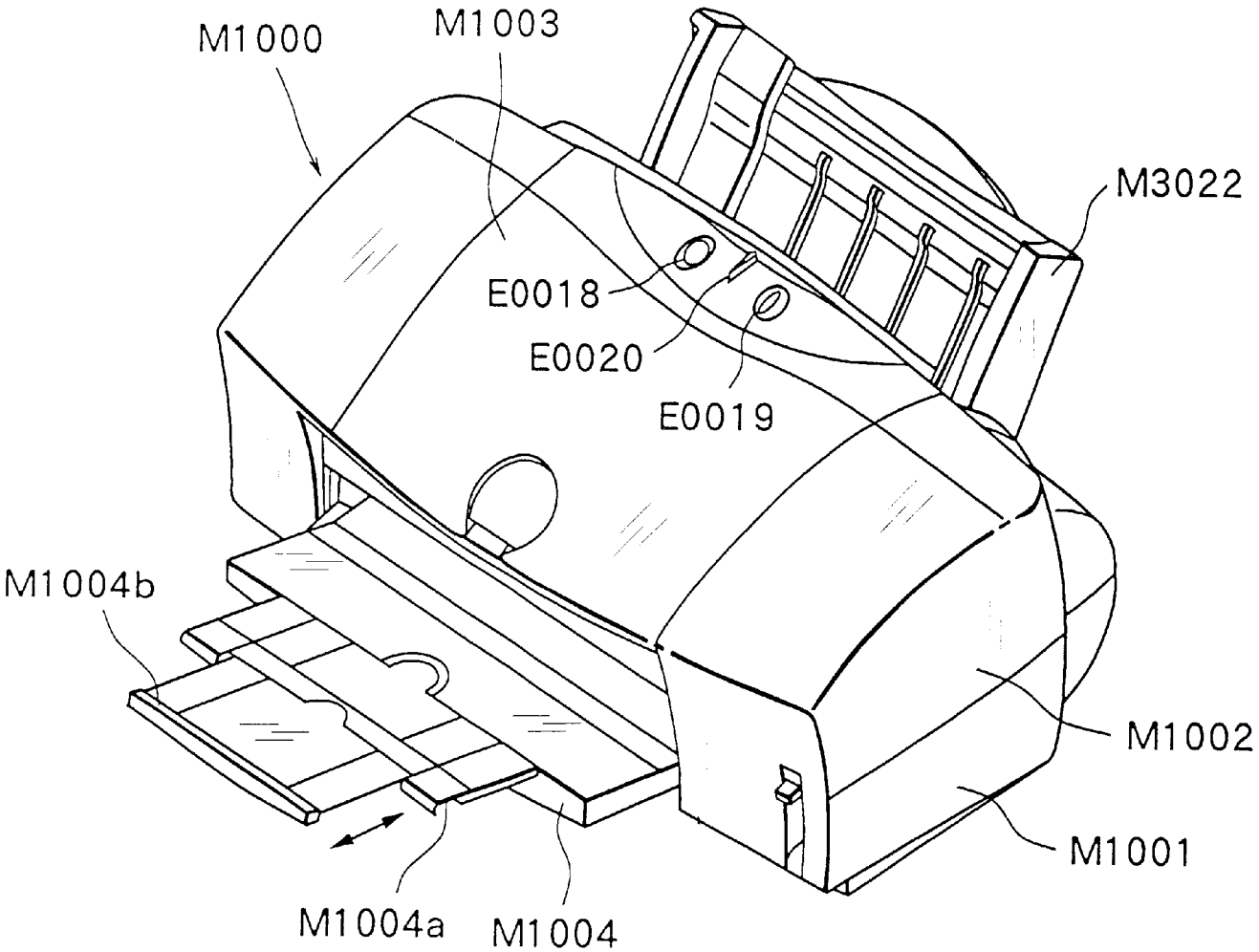
FIG. 1 is a perspective view showing the external appearance of an inkjet printer according to an embodiment of the present invention.
Figure 2:
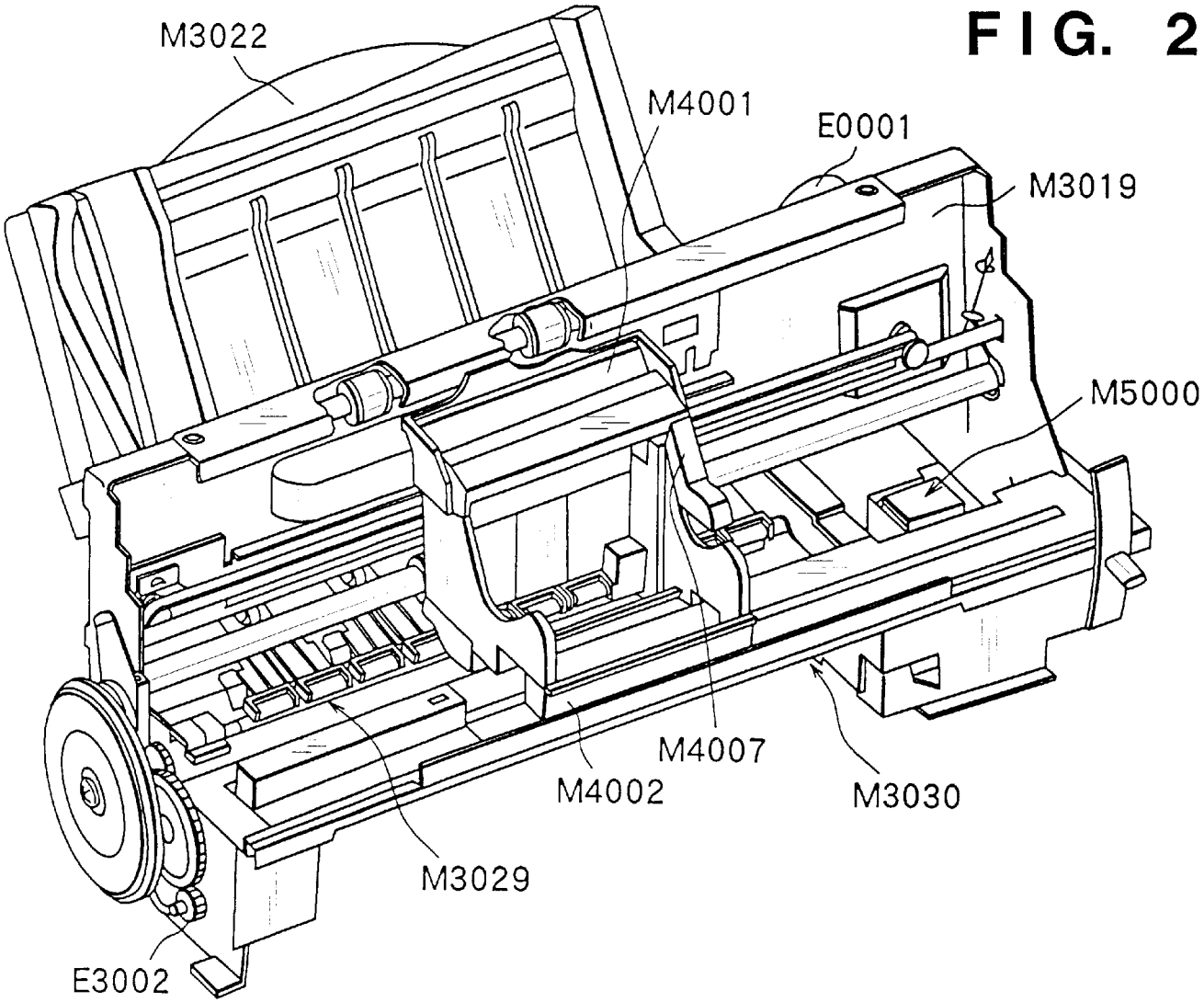
FIG. 2 is a perspective view showing the state in which external parts of the printer shown in FIG. 1 are removed.

FIGS. 1 and 2 show an outline of the arrangement of a printer using an inkjet printing system. Referring to FIG. 1, an apparatus main body M1000 as a shell of the printer according to this embodiment is composed of external members, i.e., a lower case M1001, upper case M1002, access cover M1003, and delivery tray M1004, and a chassis M3019 (FIG. 2) accommodated in these external members.

The chassis M3019 is made of a plurality of plate-like metal members having predetermined stiffness, forms a framework of the printing apparatus, and holds various printing mechanisms to be described later.

The lower case M1001 forms a substantially lower half of the apparatus main body M1000, and the upper case M1002 forms a substantially upper half of the apparatus main body M1000. The combination of these two cases forms a hollow structure having a housing space for housing diverse mechanisms to be described later. Openings are formed in the top surface and the front surface of this hollow structure.

One end portion of the delivery tray M1004 is rotatably held by the lower case M1001. By rotating this delivery tray M1004, the opening formed in the front surface of the lower case M1001 can be opened and closed. When printing is to be executed, therefore, the delivery tray M1004 is rotated forward to open the opening to allow printing sheets to be delivered from this opening, and delivered printing sheets P can be stacked in order. Also, the delivery tray M1004 accommodates two auxiliary trays M1004*a* and M1004*b*. By pulling each tray forward as needed, the sheet support area can be increased and reduced in three steps.

One end portion of the access cover M1003 is rotatably held by the upper case M1002. This allows this access cover M1003 to open and close the opening formed in the top surface of the upper case M1002. By opening this access cover M1003, a printhead cartridge H1000 or an ink tank H1900 housed inside the main body can be replaced. Although not shown, when the access cover M1003 is opened or closed, a projection formed on the rear surface of this access cover M1003 rotates a cover opening/closing lever. A microswitch or the like detects the rotated position of this lever. In this way, the open/closed state of the access cover can be detected.

Figure 7:
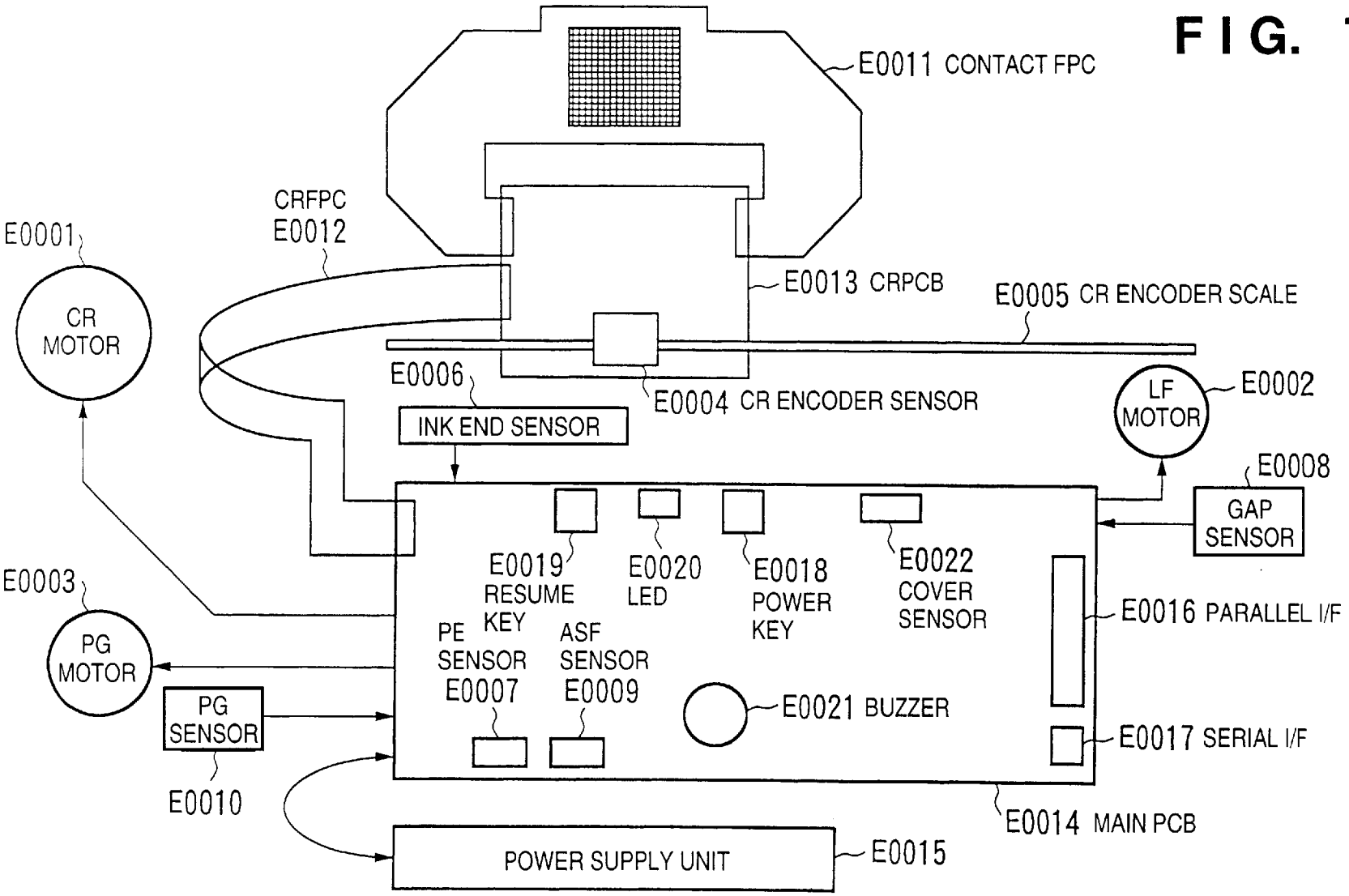
FIG. 7 is a block diagram schematically showing the overall arrangement of an electronic circuit in the embodiment of the present invention.

On the top surface in the rear portion of the upper case M1002, a power key E0018 and a resume key E0019 are arranged to be able to be pressed, and an LED E0020 is also arranged. When the power key E0018 is pressed, the LED E0020 is turned on to inform the operator that printing is possible. This LED E0020 has various display functions, e.g., informs the operator of a trouble of the printer by changing the way the LED E0020 turns on and off, changing the color of light, or sounding a buzzer E0021 (FIG. 7). When the trouble is solved, printing is restarted by pressing the resume key E0019.

[Printing Mechanisms]

Printing mechanisms of this embodiment housed in and held by the apparatus main body M1000 of the above printer will be described below.

The printing mechanisms according to this embodiment are: an automatic feeder M3022 for automatically feeding the printing sheets P into the apparatus main body; a conveyor unit M3029 for guiding the printing sheets P fed one by one from the automatic feeder to a desired printing position and guiding these recording sheets P from the printing position to a delivery unit M3030; a printing unit for performing desired printing on each printing sheet P conveyed by the conveyor unit M3029; and a recovery unit (M5000) for recovering, e.g., the printing unit.

(Printing Unit)

The printing unit will be described below.

This printing unit includes a carriage M4001 movably supported by a carriage shaft M4021, and the printhead cartridge H1000 detachably mounted on this carriage M4001.

Printhead Cartridge

First, the printhead cartridge will be described with reference to FIGS. 3 to 5.

Figure 3:
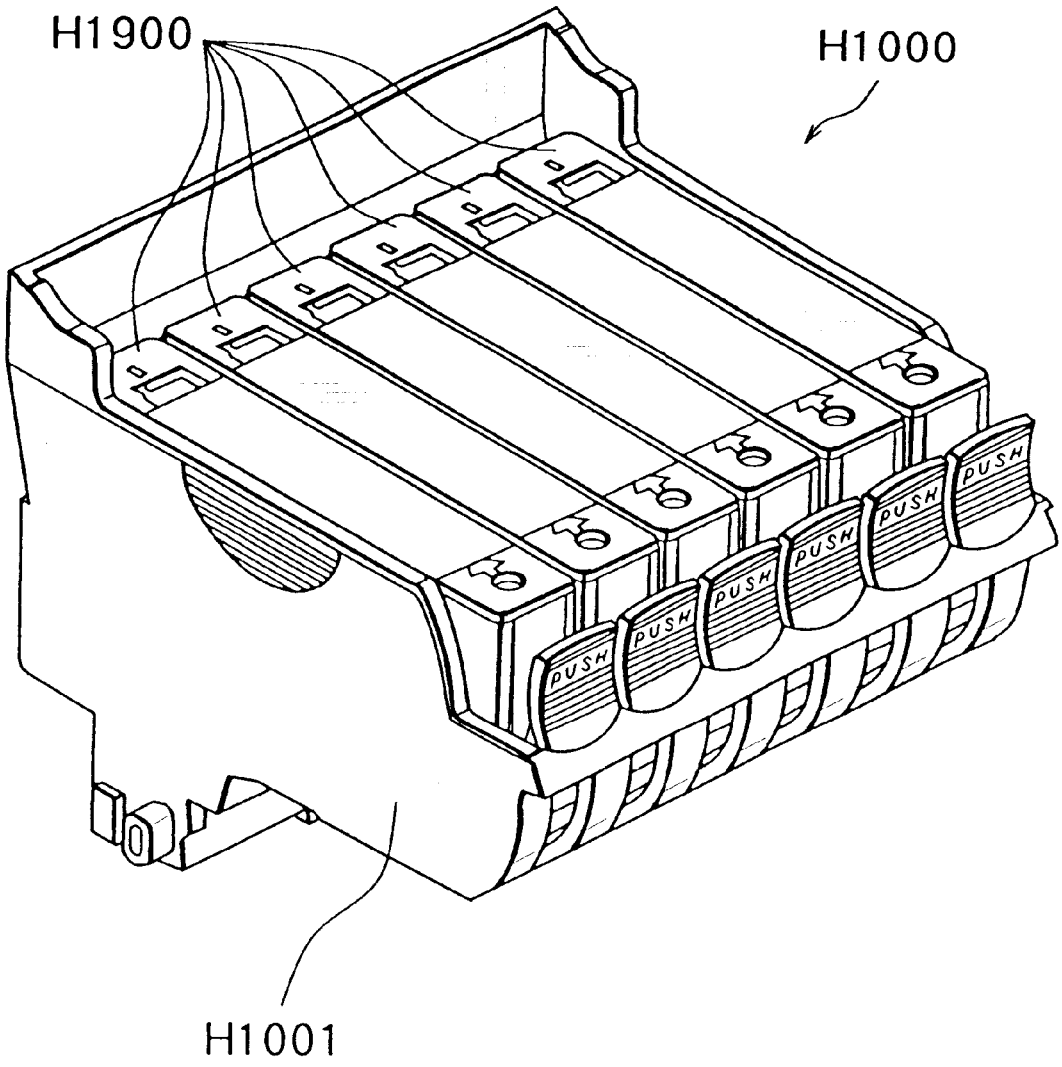
FIG. 3 is a perspective view showing a printhead cartridge used in the embodiment of the present invention.
Figure 4:
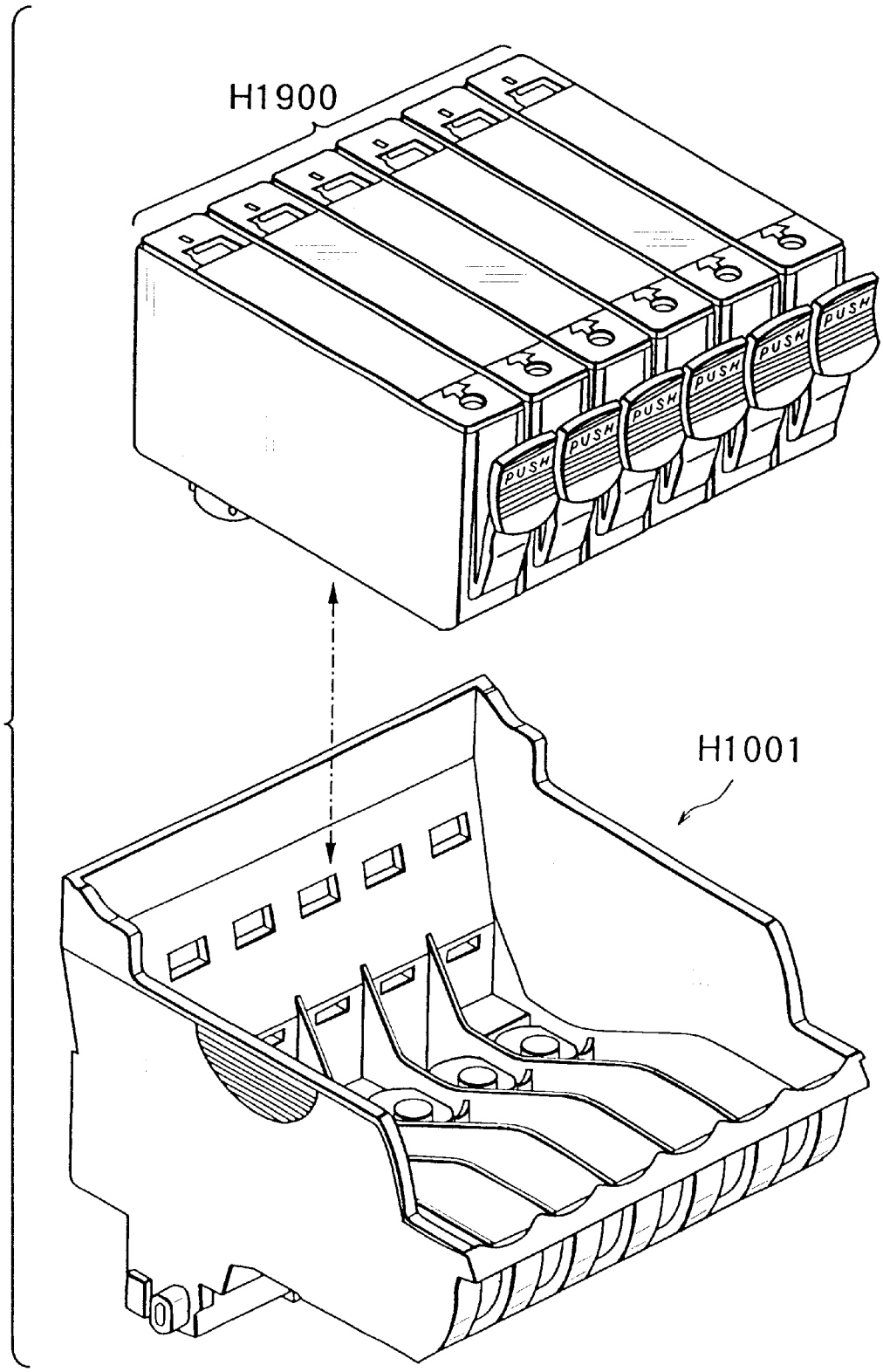
FIG. 4 is an exploded perspective view showing how the printhead cartridge shown in FIG. 3 is assembled.

As shown in FIG. 3, the printhead cartridge H1000 of this embodiment has the ink tank H1900 containing ink and a printhead H1001 for discharging the ink supplied from this ink tank H1900 from nozzles in accordance with printing information. This printhead H1001 is of a so-called cartridge type detachably mounted on the carriage M4001 (to be described later).

To make photographic high-quality color printing feasible, the printhead cartridge H1000 of this embodiment includes independent color ink tanks, e.g., black, light cyan, light magenta, cyan, magenta, and yellow ink tanks. As shown in FIG. 4, these ink tanks can be independently attached to and detached from the printhead H1001.

Figure 5:
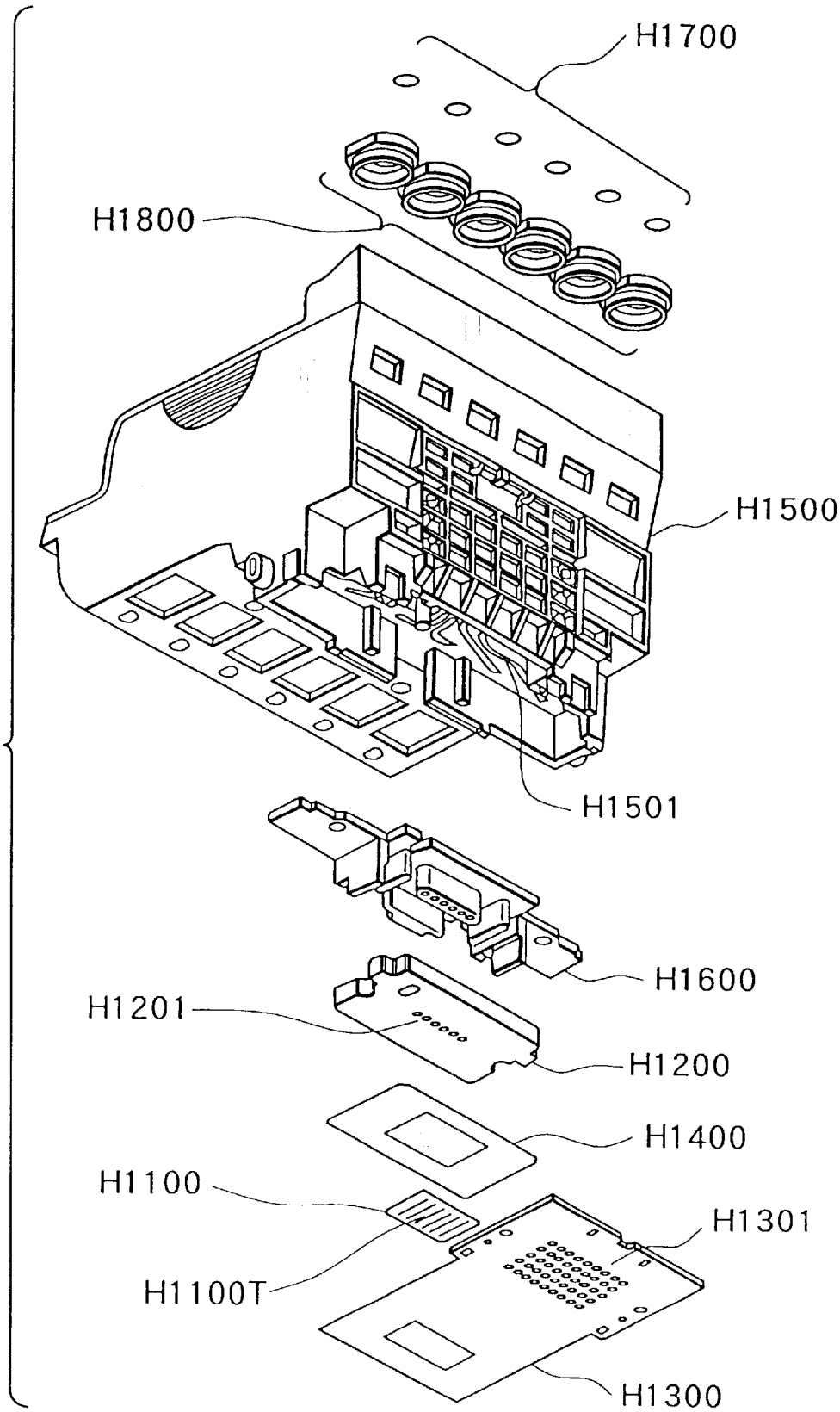
FIG. 5 is an exploded perspective view showing the printhead of FIG. 4 when obliquely viewed from below.

As shown in an exploded perspective view of FIG. 5, the printhead H1001 comprises a printing element board (substrate) H1100, first plate H1200, electric printed circuit board (substrate) H1300, second plate H1400, tank holder H1500, channel forming member H1600, filters H1700, and sealing rubber members H1800.

On the printing element board H1100, a plurality of printing elements for discharging ink and electric lines made of, e.g., Al for supplying electric power to these printing elements are formed on one surface of an Si substrate by film formation technologies. A plurality of ink channels and a plurality of discharge orifices H1100T corresponding to the printing elements are formed by photolithography. Also, ink supply ports for supplying ink to these ink channels are formed in the rear surface. This printing element board H1100 is fixed to the first plate H1200 by adhesion. Ink supply ports H1201 for supplying ink to the printing element board H1100 are formed in this first plate H1200. Furthermore, the second plate H1400 having an opening is fixed to the first plate H1200 by adhesion. This second plate H1400 holds the electric printed circuit board 1300 such that the electric printed circuit board H1300 and the printing element board H1100 are electrically connected.

This electric printed circuit board H1300 applies an electrical signal for discharging ink to the printing element board H1100. The electric printed circuit board H1300 has electric lines corresponding to the printing element board H1100, and external signal input terminals H1301 formed in end portions of these electric lines to receive electrical signals from the main body. The external signal input terminals H1301 are positioned and fixed at the back of the tank holder H1500.

The channel forming member H1600 is ultrasonically welded to the tank holder H1500 for detachably holding the ink tanks H1900, thereby forming ink channels H1501 from the ink tanks H1900 to the first plate H1200. Also, the filters H1700 are formed at those end portions of the ink channels H1501, which engage with the ink tanks H1900, to prevent invasion of dust from the outside. The sealing rubber members H1800 are attached to the portions engaging with the ink tanks H1900 to prevent evaporation of ink from these engaging portions.

Furthermore, the printhead H1001 is constructed by bonding, by an adhesive or the like, a tank holder unit composed of the tank holder H1500, channel forming member H1600, filters H1700, and sealing rubber members H1800 to a printing element unit composed of the printing element board H1100, first plate H1200, electric printed circuit board H1300, and second plate H1400.

(Carriage)

The carriage M4001 will be described below with reference to FIG. 2.

As shown in FIG. 2, this carriage M4001 includes a carriage cover M4002 and head set lever M4007. The carriage cover M4002 engages with the carriage M4001 and guides the printhead H1001 to the mount position of the carriage M4001. The head set lever M4007 engages with the tank holder H1500 of the printhead H1001 and pushes the printhead H1000 such that the printhead H1000 is set in a predetermined mount position.

That is, the head set lever M4007 is set in the upper portion of the carriage M4001 so as to be pivotal about a head set level shaft. Also, a head set plate (not shown) is set via a spring in a portion which engages with the printhead H1001. By the force of this spring, the printhead H1001 is pushed and mounted on the carriage M4001.

A contact flexible print cable (to be referred to as a contact FPC hereinafter) E0011 is set in another engaging portion of the carriage M4001 with respect to the printhead H1001. Contact portions E0011*a* on this contact FPC E0011 and the contact portions (external signal input terminals) H1301 formed on the printhead H1001 electrically contact each other to exchange various pieces of information for printing or supply electric power to the printhead H1001.

An elastic member (not shown) made of, e.g., rubber is formed between the contact portions E0011*a* of the contact FPC E0011 and the carriage M4001. The elastic force of this elastic member and the biasing force of the head set lever spring make reliable contact between the contact portions E0011*a* and the carriage M4001 possible. Furthermore, the contact FPC E0011 is connected to a carriage printed circuit board E0013 mounted on the back surface of the carriage M4001 (FIG. 7).

[Scanner]

The printer of this embodiment is also usable as a reading apparatus by replacing the printhead with a scanner.

This scanner moves together with the carriage of the printer and reads an original image supplied instead of a printing medium in a sub-scan direction. Information of one original image is read by alternately performing the read operation and the original feed operation.

Figure 6B:
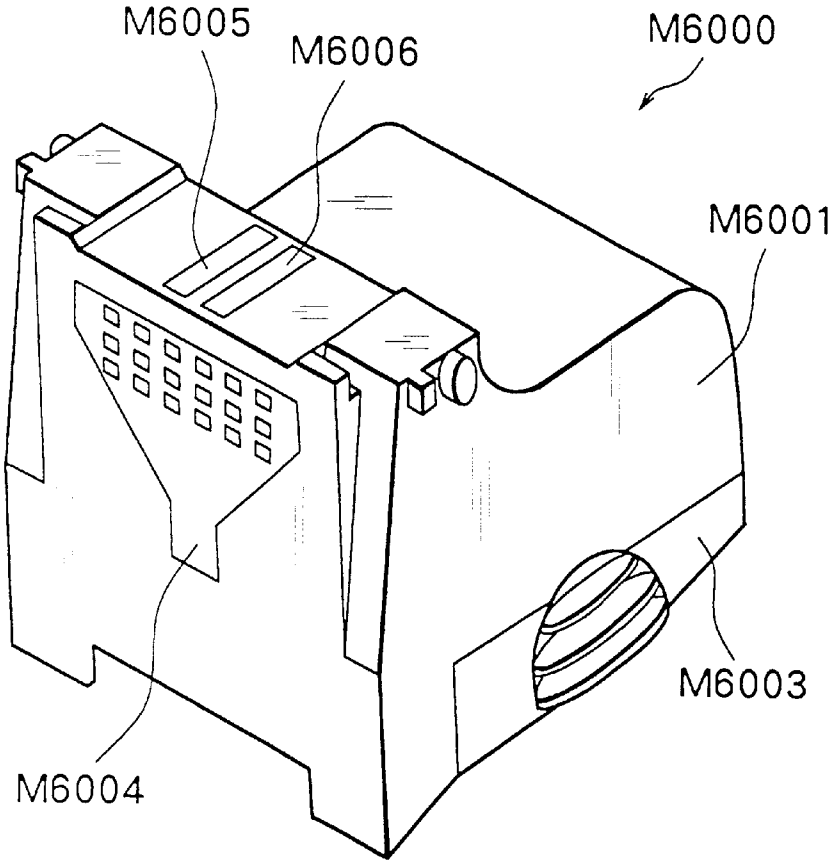
FIGS. 6A and 6B are perspective views showing a scanner cartridge in the embodiment of the present invention.
Figure 6A:
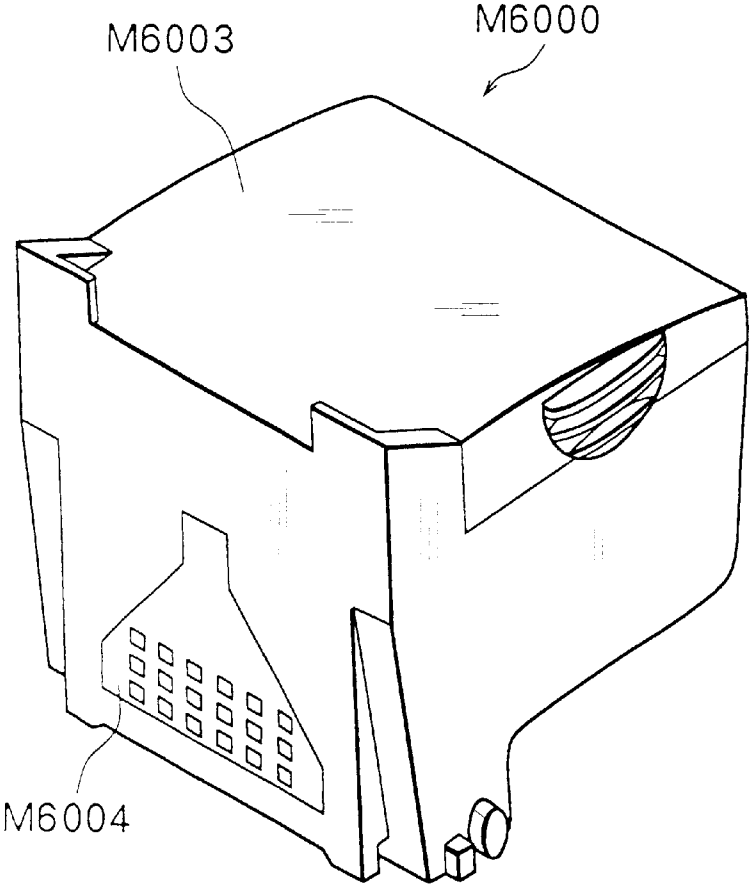

FIGS. 6A and 6B are views showing an outline of the arrangement of this scanner M6000.

As shown in FIGS. 6A and 6B, a scanner holder M6001 has a box-like shape and contains optical systems and processing circuits necessary for reading. A scanner read lens M6006 is placed in a portion which faces the surface of an original when this scanner M6000 is mounted on the carriage M4001. This scanner read lens M6006 reads an original image. A scanner illuminating lens M6005 contains a light source (not shown), and light emitted by this light source irradiates an original.

A scanner cover M6003 fixed to the bottom portion of the scanner holder M6001 so fits as to shield the interior of the scanner holder M6001 from light. Louver-like handles formed on the side surfaces of this scanner cover M6003 facilitate attachment to and detachment from the carriage M4001. The external shape of the scanner holder M6001 is substantially the same as the printhead cartridge H1000. So, the scanner holder M6001 can be attached to and detached from the carriage M4001 by operations similar to the printhead cartridge H1000.

Also, the scanner holder M6001 accommodates a board having the processing circuits described above and a scanner contact PCB M6004 connected to this board and exposed to the outside. When the scanner M6000 is mounted on the carriage M4001, this scanner contact PCB M6004 comes in contact with the contact FPC E0011 of the carriage M4001, thereby electrically connecting the board to the control system of the main body via the carriage M4001.

An electric circuit configuration in this embodiment of the present invention will be described next.

FIG. 7 is a view schematically showing the overall arrangement of an electric circuit in this embodiment.

The electric circuit of this embodiment primarily comprises the carriage printed circuit board (CRPCB) E0013, a main PCB (Printed Circuit Board) E0014, and a power supply unit E0015.

The power supply unit is connected to the main PCB E0014 to supply various driving power.

The carriage printed circuit board E0013 is a printed circuit board unit mounted on the carriage M4001 (FIG. 2) and functions as an interface for exchanging signals with the printhead through the contact FPC E0011. Also, on the basis of a pulse signal output from an encoder sensor E0004 in accordance with the movement of the carriage M4001, the carriage printed circuit board E0013 detects changes in the positional relationship between an encoder scale E0005 and the encoder sensor E0004 and outputs a signal to the main PCB E0014 through a flexible flat cable (CRFFC) E0012.

The main PCB is a printed circuit board unit for controlling driving of individual parts of the inkjet printing apparatus of this embodiment. This main PCB has, on the board, I/O ports for, e.g., a paper end sensor (PE sensor) E0007, an ASF sensor E0009, a cover sensor E0022, a parallel interface (parallel I/F) E0016, a serial interface (serial I/F) E0017, the resume key E0019, the LED E0020, the power key E0018, and the buzzer E0021. The main PCB is also connected to a CR motor E0001, an LF motor E0002, and a PG motor E0003 to control driving of these motors. Additionally, the main PCB has interfaces connecting to an ink end sensor E0006, a GAP sensor E0008, a PG sensor E0010, a CRFFC E0012, and the power supply unit E0015.

Figure 8:
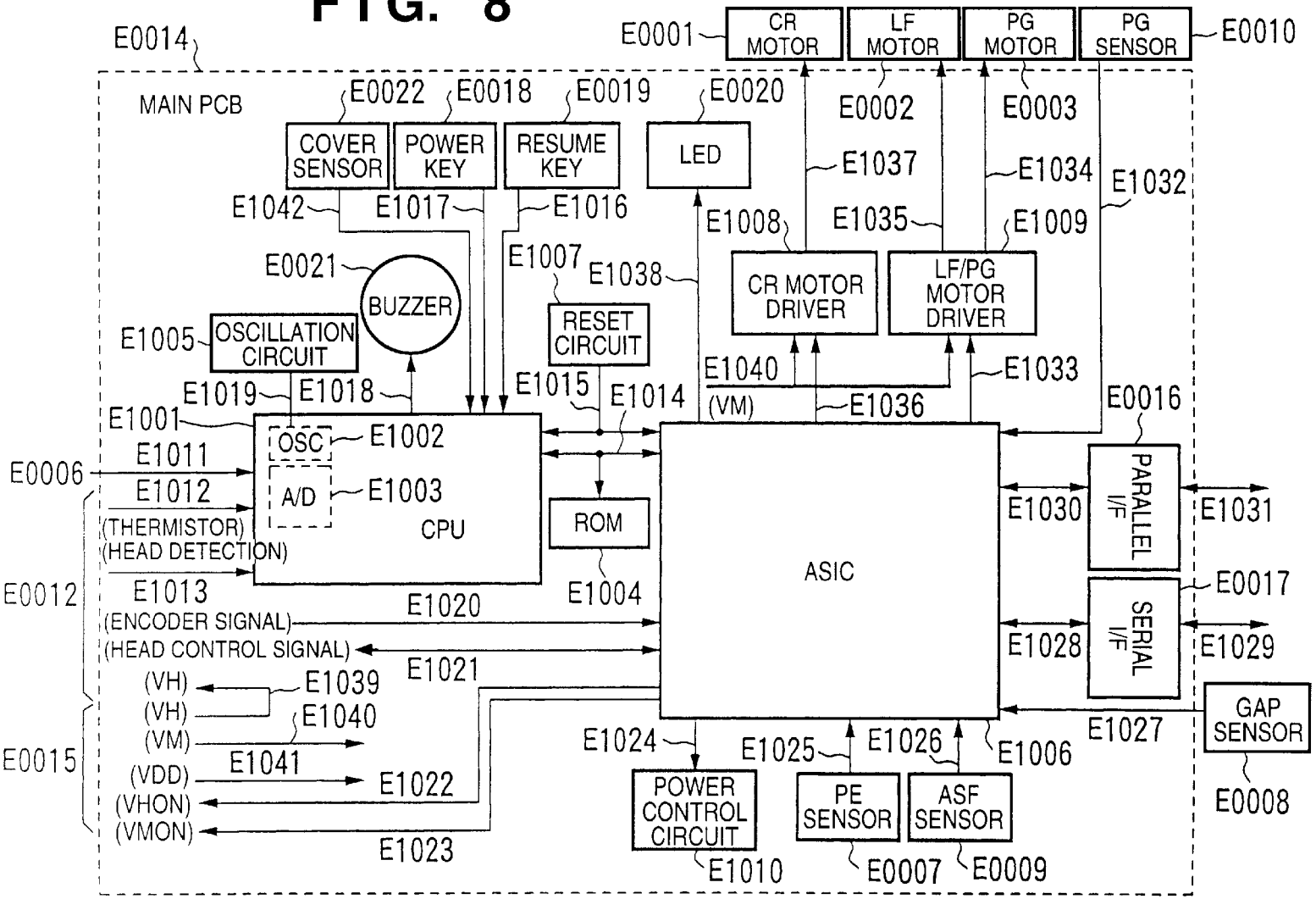
FIG. 8 is a block diagram showing the internal arrangement of a main PCB shown in FIG. 7.

FIG. 8 is a block diagram showing the internal arrangement of the main PCB.

Referring to FIG. 8, a CPU E1001 internally has an oscillator OSC E1002 and is connected to an oscillation circuit E1005 to generate a system clock by an output signal E1019 from the oscillation circuit E1005. Also, the CPU E1001 is connected to a ROM E1004 and an ASIC (Application Specific Integrated Circuit) E1006. In accordance with programs stored in the ROM E1004, the CPU E1001 controls the ASIC and senses the statuses of an input signal E1017 from the power key, an input signal E1016 from the resume key, a cover sensing signal E1042, and a head sensing signal (HSENS) E1013. Additionally, the CPU E1001 drives the buzzer E0021 by a buzzer signal (BUZ) E1018 and senses the statuses of an ink end sensing signal (INKS) E1011 and a thermistor temperature sensing signal (TH) E1012 connected to a built-in A/D converter E1003. Furthermore, the CPU E1001 controls driving of the inkjet printing apparatus by performing various logic operations and condition judgements.

The head sensing signal E1013 is a head mounting sensing signal which the printhead cartridge H1000 inputs via the flexible flat cable E0012, the carriage printed circuit board E0013, and the contact flexible print cable E0011. The ink end sensing signal is an output analog signal from the ink end sensor E0006. The thermistor temperature sensing signal E1012 is an analog signal from a thermistor (not shown) formed on the carriage printed circuit board E0013.

A CR motor driver E1008 is supplied with motor power (VM) E1040 as a driving source. In accordance with a CR motor control signal E1036 from the ASIC E1006, the CR motor driver E1008 generates a CR motor driving signal E1037 to drive the CR motor E0001. An LF/PG motor driver E1009 is also supplied with the motor power E1040 as a driving source. In accordance with a pulse motor control signal (PM control signal) E1033 from the ASIC E1006, the LF/PG motor driver E1009 generates an LF motor driving signal E1035 to drive the LF motor and also generates a PG motor driving signal E1034 to drive the PG motor.

A power control circuit E1010 controls power supply to each sensor having a light-emitting element, in accordance with a power control signal E1024 from the ASIC E1006. The parallel I/F E0016 transmits a parallel I/F signal E1030 from the ASIC E1006 to a parallel I/F cable E1031 connected to the outside, and transmits signals from this parallel I/F cable E1031 to the ASIC E1006. The serial IF E0017 transmits a serial I/F signal E1028 from the ASIC E1006 to a serial I/F cable E1029 connected to the outside, and transmits signals from this cable E1029 to the ASIC E1006.

The power supply unit E0015 supplies head power (VH) E1039, the motor power (VM) E1040, and logic power (VDD) E1041. A head power ON signal (VHON) E1022 and a motor power ON signal (VMOM) E1023 from the ASIC E1006 are input to the power supply unit E0015 to control ON/OFF of the head power E1039 and the motor power E1040, respectively. The logic power (VDD) E1041 supplied from the power supply unit E0015 is subjected to voltage transformation where necessary and supplied to individual units inside and outside the main PCB E0014.

The head power E1039 is smoothed on the main PCB E0014, supplied to the flexible flat cable E0011, and used to drive the printhead cartridge H1000.

A reset circuit E1007 detects a decrease in the logic power-supply voltage E1040 and supplies a reset signal (RESET) E1015 to the CPU E1001 and the ASIC E1006 to initialize them.

This ASIC E1006 is a one-chip semiconductor integrated circuit which is controlled by the CPU E1001 via a control bus E1014, outputs the CR motor control signal E1036, the PM control signal E1033, the power control signal E1024, the head power ON signal E1022, and the motor power ON signal E1023, and exchanges signals with the parallel I/F E10016 and the serial I/F E0017. Also, the ASIC E1006 senses the statuses of a PE sensing signal (PES) E1025 from the PE sensor E0007, an ASF sensing signal (ASFS) E1026 from the ASE sensor E0009, a GAP sensing signal (GAPS) E1027 from the GAP sensor E0008, and a PG sensing signal (PGS) E1032 from the PG sensor E0010, and transmits data indicating the statuses to the CPU E1001 through the control bus E1014. On the basis of the input data, the CPU E1001 controls driving of the LED driving signal E1038 to turn on and off the LED E0020.

Furthermore, the ASIC E1006 senses the status of an encoder signal (ENS) E1020 to generate a timing signal and interfaces with the printhead cartridge H1000 by a head control signal E1021, thereby controlling a printing operation. The encoder signal (ENC) E1020 is an output signal from the CR encoder sensor E0004, that is input through the flexible flat cable E0012. The head control signal E1021 is supplied to the printhead cartridge E1000 through the flexible flat cable E0012, the carriage printed circuit board E0013, and the contact FPC E0011.

FIG. 9 is a block diagram showing the internal arrangement of the ASIC E1006.

Referring to FIG. 9, only flows of data, such as printing data and motor control data, pertaining to control of the head and each mechanical part are shown in connections between individual blocks. Control signals and clocks concerning read and write of a built-in register in each block and control signals related to DMA control are omitted to avoid the complexity of description in the drawing.

As shown in FIG. 9, a PLL E2002 generates a clock (not shown) to be supplied to the most part of the ASIC E1006, in accordance with a clock signal (CLK) E2031 and PLL control signal (PLLON) E2033 output from the CPU E1001.

A CPU interface (CPU I/F) E2001 controls read and write to a register in each block (to be described below), supplies clocks to some blocks, and accepts an interrupt signal (none of these functions is shown), in accordance with the reset signal E1015, a soft reset signal (PDWN) E2032 and the clock signal (CLK) E2031 output from the CPU E1001, and a control signal from the control bus E1014. This CPU I/F E2001 outputs an interrupt signal (INT) E2034 to the CPU E1001 to inform the CPU E1001 of generating an interrupt in the ASIC E1006.

A DRAM E2005 has areas such as a receiving buffer E2010, work buffer E2011, print buffer E2014, and expanding data buffer E2016, as printing data buffers, and also has a motor control buffer E2023 for motor control. In addition to these printing data buffers, the DRAM E2005 has areas such as a scanner loading buffer E2024, scanner data buffer E2026, and sending buffer E2028, as buffers for use in a scanner operation mode.

This DRAM E2005 is also used as a work area necessary for the operation of the CPU E1001. That is, a DRAM controller E2004 switches between access from the CPU E1001 to the DRAM E2005 using the control bus and access from a DMA controller E2003 (to be described below) to the DRAM E2005, thereby performing read and write to the DRAM E2005.

The DMA controller E2003 accepts a request (not shown) from each block and outputs, to the RAM controller, an address signal and a control signal (neither is shown), or write data (E2038, E2041, E2044, E2053, E2055, or E2057) when a write operation is to be performed, thereby performing DRAM access. When a read operation is to be performed, the DMA controller E2003 transfers readout data (E2040, E2043, E2045, E2051, E2054, E2056, E2058, or E2059) from the DRAM controller E2004 to the block which has requested.

A 1284 I/F E2006 interfaces by two-way communication with an external host apparatus (not shown) through the parallel I/F E0016 under the control of the CPU E1001 via the CPU I/F E2001. Also, when printing is to be performed, the 1284 I/F E2006 transfers received data (PIF received data E2036) from the parallel I/F E0016 to a reception controller E2008 by DMA processing. When scanner read is to be performed, the 1284 I/F E2006 transmits data (1284 transmission data (RDPIF) E2059) stored in the sending buffer E2028 in the DRAM E2005 to the parallel I/F by DMA processing.

A USB I/F E2007 interfaces by two-way communication with an external host apparatus (not shown) through the serial I/F E0017 under the control of the CPU E1001 via the CPU I/F E2001. Also, when printing is to be performed, the USB I/F E2007 transfers received data (USB received data E2037) from the serial I/F E0017 to the reception controller E2008 by DMA processing. When scanner read is to be performed, the USB I/F E2007 transmits data (USB transmission data (RDPIF) E2058) stored in the sending buffer E2028 in the DRAM E2005 to the serial I/F by DMA processing. The reception controller E2008 writes received data (WDIF) E2038) from a selected one of the 1284 I/F E2006 and the USB I/F E2007 into a receiving buffer write address managed by a receiving buffer controller E2039.

A compression-expansion DMA E2009 reads out, under the control of the CPU E1001 via the CPU I/F E2001, received data (raster data) stored on the receiving buffer E2010 from a receiving buffer read address managed by the receiving buffer controller E2039, compresses or expands readout data (RDWK) E2040 in accordance with a designated mode, and writes the data as a printing code string (WDWK) E2041 in the work buffer area.

A printing buffer transfer DMA E2013 reads out, under the control of the CPU E1001 via the CPU I/F E2001, printing codes (RDWP) E2043 on the work buffer E2011, rearranges each printing code into an address on the print buffer E2014, which is suitable for the order of data transfer to the printhead cartridge H1000, and transfers the code (WDWP E2044). A work clear DMA E2012 repeatedly transfers and writes, under the control of the CPU E1001 via the CPU I/F E2001, designated work file data (WDWF) E2042 in a region on the work buffer to which the data is completely transferred by the printing buffer transfer DMA E2015.

A printing data expanding DMA E2015 reads out, under the control of the CPU E1001 via the CPU I/F E2001, the printing codes rearranged and written on the print buffer and expanding data written on the expanding data buffer E2016, by using a data expansion timing signal E2050 from a head controller E2018 as a trigger, thereby generating expanded printing data (WDHDG) E2045, and writes the generated data as column buffer write data (WDHDG) E2047 in a column buffer E2017. This column buffer E2017 is an SRAM for temporarily storing data (expanded printing data) to be transferred to the printhead cartridge H1000. The column buffer E2017 is shared and managed by the printing data expanding DMA and the head controller in accordance with a handshake signal (not shown) of these two blocks.

Under the control of the CPU E1001 via the CPU I/F E2001, this head controller E2018 interfaces with the printhead cartridge H1000 or the scanner via a head control signal. In addition, on the basis of a head driving timing signal E2049 from an encoder signal processor E2019, the head controller E2018 outputs a data expansion timing signal E2050 to the printing data expanding DMA.

When printing is to be performed, the head controller E2018 reads out expanded printing data (RDHD) E2048 from the column buffer in accordance with the head driving timing signal E2049. The head controller E2018 outputs the readout data to the printhead cartridge H1000 via the head control signal E1021.

In a scanner read mode, the head controller E2018 transfers loaded data (WDHD) E2053 input via the head control signal E1021 to the scanner loading buffer E2024 on the DRAM E2005 by DMA transfer. A scanner data processing DMA E2025 reads out, under the control of the CPU E1001 via the CPU I/F E2001, loading buffer readout data (RDAV) E2054 stored in the scanner loading buffer E2024 into a scanner data buffer E2026 on the DRAM E2005 and writes processed data (WDAV) E2055, subjected to processing such as averaging, into the scanner data buffer E2016 on the DRAM E2005.

A scanner data compressing DMA E2027 reads out processed data (RDYC) E2056 on the scanner data buffer E2026, compresses the data, and writes compressed data (WDYC) E2057 in the sending buffer E2028, under the control of the CPU E1001 via the CPU I/F E2001.

The encoder signal processor E2019 receives an encoder signal (ENC) and outputs the head driving timing signal E2049 in accordance with a mode determined by the control of the CPU E1001. In addition, the encoder signal processor E2019 stores information concerning the position or speed of the carriage M4001, obtained from the encoder signal E1020, into a register and provides the information to the CPU E1001. On the basis of this information, the CPU E1001 determines various parameters for controlling the CR motor E0001. A CR motor controller E2020 outputs a CR motor control signal E1036 under the control of the CPU E1001 via the CPU I/F E2001.

A sensor signal processor E2022 receives output sensing signals from, e.g., the PG sensor E0010, the PE sensor E0007, the ASF sensor E0009, and the GAP sensor E0008, and transmits these pieces of sensor information to the CPU E1001 in accordance with a mode determined by the control of the CPU E1001. The sensor signal processor E2022 also outputs a sensor signal E2052 to an LF/PG motor control DMA E2021.

Under the control of the CPU E1001 via the CPU I/F E2001, this LF/PG motor control DMA E2021 reads out a pulse motor driving table (RDPM) E2051 from a motor control buffer E2023 on the DRAM E2005 and outputs a pulse motor control signal E. In addition, the LF/PG motor control DMA E2021 outputs a pulse motor control signal E1033 by using the above-mentioned sensor signal as a trigger of the control.

An LED controller E2030 outputs an LED driving signal E1038 under the control of the CPU E1001 via the CPU I/F E2001. A port controller E2029 outputs the head power ON signal E1022, the motor power ON signal E1023, and the power control signal E1024 under the control of the CPU E1001 via the CPU I/F E2001.

Figure 10:
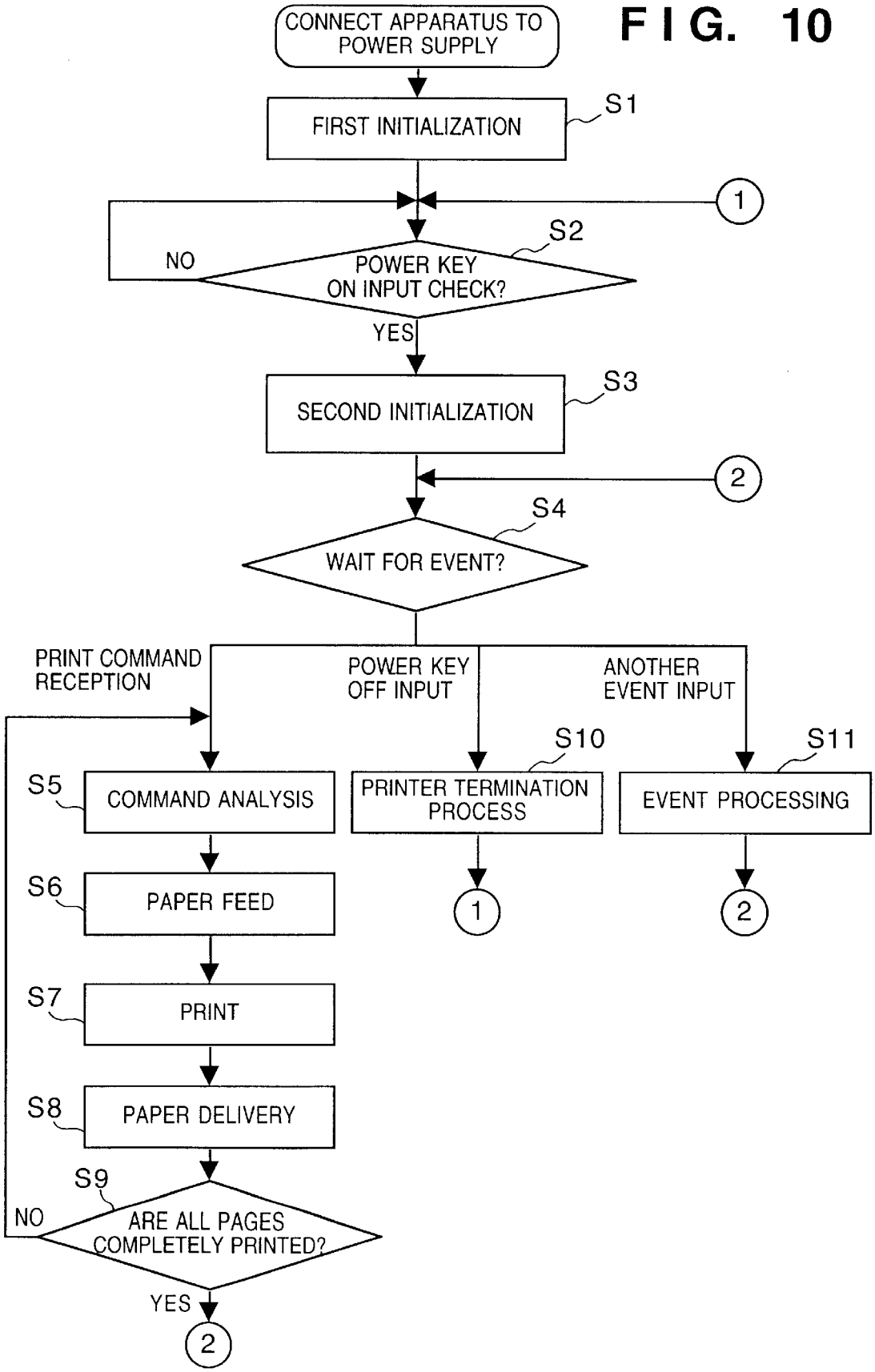
FIG. 10 is a flow chart showing the operation of the embodiment of the present invention.

The operation of the inkjet printing apparatus of this embodiment of the present invention constructed as above will be described below with reference to a flow chart in FIG. 10.

When this apparatus is connected to the AC power supply, in step S1 first initialization is performed for the apparatus. In this initialization, the electric circuit system including, e.g., the ROM and RAM of this apparatus is checked, thereby checking whether the apparatus can normally operate electrically.

In step S2, whether the power key E0018 on the upper case M1002 of the apparatus main body M1000 is pressed is checked. If the power key E0018 is pressed, the flow advances to step S3 to perform second initialization.

In this second initialization, the various driving mechanisms and the head system of this apparatus are checked. That is, whether the apparatus is normally operable is checked in initializing the various motors and loading head information.

In step S4, an event is waited for. That is, a command event from the external I/F, a panel key event by a user operation, or an internal control event with respect to this apparatus is monitored. If any of these events occurs, processing corresponding to the event is executed.

For example, if a printing command event is received from the external I/F in step S4, the flow advances to step S5. If a power key event by a user operation occurs in step S4, the flow advances to step S10. If another event occurs in step S4, the flow advances to step S11.

In step S5, the printing command from the external I/F is analyzed to determine the designated paper type, sheet size, printing quality, and paper feed method. Data indicating these determination results is stored in the RAM E2005 of the apparatus, and the flow advances to step S6.

In step S6, paper feed is started by the paper feed method designated in step S5. When the sheet is fed to a printing start position, the flow advances to step S7.

In step S7, printing is performed. In this printing, printing data supplied from the external I/F is once stored in the printing buffer. Subsequently, the CR motor E0001 is driven to start moving the carriage M4001 in the scanning direction, and the printing data stored in the print buffer E2014 is supplied to the printhead cartridge H1000 to print one line. When the printing data of one line is completely printed, the LF motor E0002 is driven to rotate an LF roller M3001 to feed the sheet in the sub-scan direction. After that, the above operation is repeatedly executed. When printing of the printing data of one page supplied from the external I/F is completed, the flow advances to step S8.

In step S8, the LF motor E0002 is driven to drive a sheet delivery roller M2003. Sheet feed is repeated until it is determined that the sheet is completely delivered from this apparatus. When this operation is completed, the sheet is completely delivered onto the sheet delivery tray M1004*a*.

In step S9, whether printing of all pages to be printed is completed is checked. If pages to be printed remain, the flow returns to step S5 to repeat the operation in steps S5 to S9 described above. When printing of all pages to be printed is completed, the printing operation is completed. After that, the flow returns to step S4 to wait for the next event.

In step S10, a printer termination process is performed to stop the operation of this apparatus. That is, to shut off the power supply to the various motors and the head, the operation transits to a state in which the power supply can be shut off. After that, the power supply is shut off, and the flow returns to step S4 to wait for the next event.

In step S11, event processing other than the above is performed. For example, processing corresponding to any of the diverse panel keys of this apparatus, a recovery command from the external I/F, or an internally occurring recovery event is performed. After the processing, the flow advances to step S4 to wait for the next event.

The circuit arrangement of a printhead H1001 in this embodiment will be described.

Figure 11:
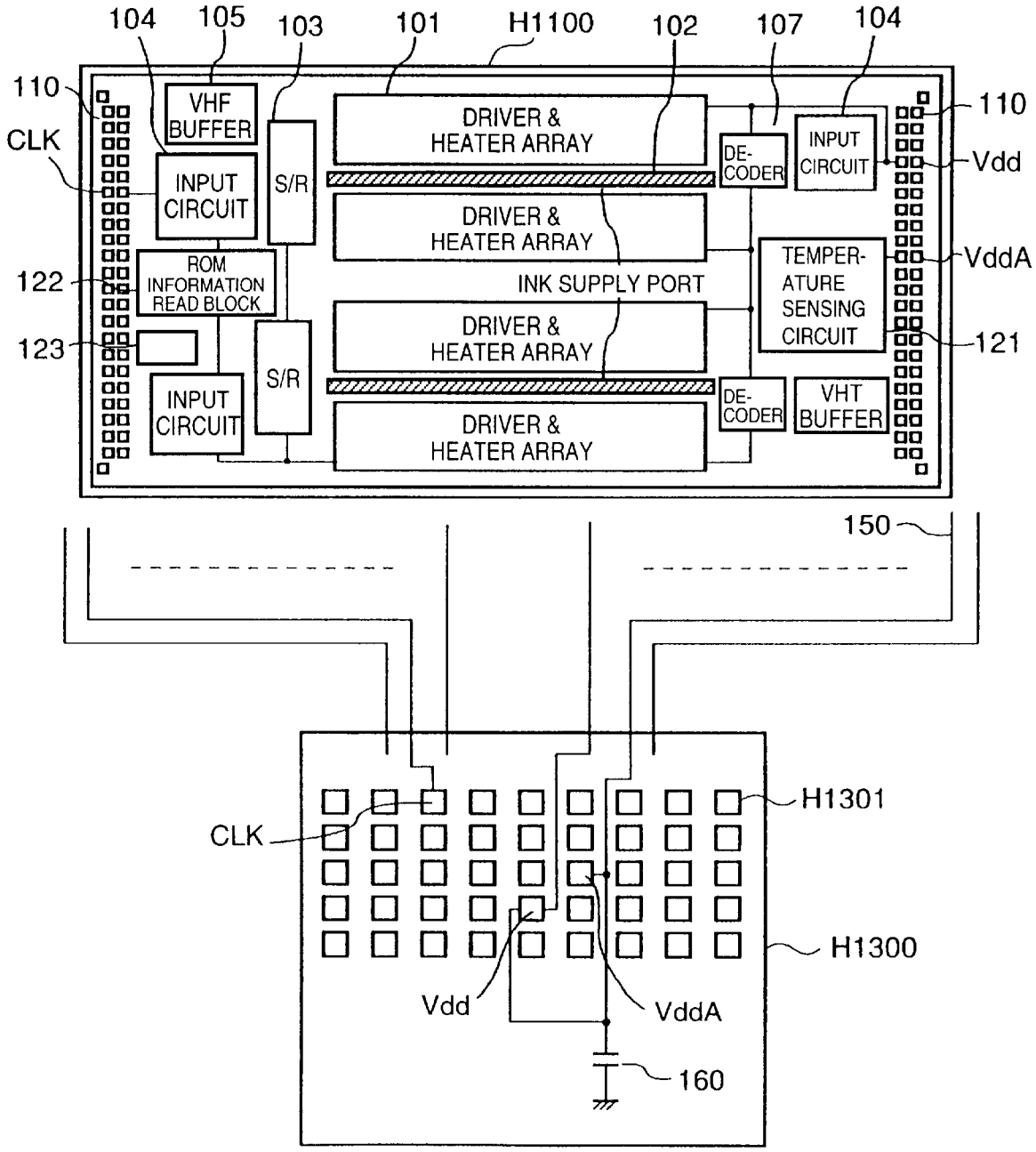
FIG. 11 is a block diagram showing the circuit arrangement of the printhead in the embodiment of the present invention.

FIG. 11 is a block diagram for explaining the circuit arrangement of the printhead H1001 in this embodiment. Reference numeral H1100 denotes a printing element board (substrate) on which heaters and driving circuits are integrally formed by a semiconductor process technique; 102, ink supply ports for supplying ink from the lower surface of the board; 101, driver & heater arrays on which pluralities of heaters and driver circuits are arrayed; 103, shift registers for temporarily holding printing data to be printed; 107, decoders for selecting and driving desired heater blocks in the driver & heater arrays; 104, input circuits including buffers for inputting digital signals to the shift registers and decoders; 110, input terminals; 121, a temperature sensing block for sensing the temperature of the board, converting the information into a digital signal, and outputting the digital signal; 122, a ROM information read block for ranking information unique to the board, e.g., heater resistance values or the ON resistance values of driver transistors, writing the information in a nonvolatile memory (not shown) arranged on the same board, and reading out the information if necessary; 123, a ranking element for measuring unique information to be written in the ROM, e.g., heater resistance values or the ON resistance values of transistors; and 105, power supply buffers for supplying gate voltages to the transistors of the driver arrays 101.

Reference numeral H1300 denotes an electric printed circuit board (substrate) having external signal input terminals H1301 for receiving a clock signal (CLK), power supply voltage (Vdd), analog power supply voltage (VddA), and the like; and 160, a noise component removing capacitor commonly connected to the power supply voltage (Vdd) and analog power supply voltage (VddA). The printing element board H1100 and electric printed circuit board H1300 are connected by a flexible cable 150.

Figure 12A:
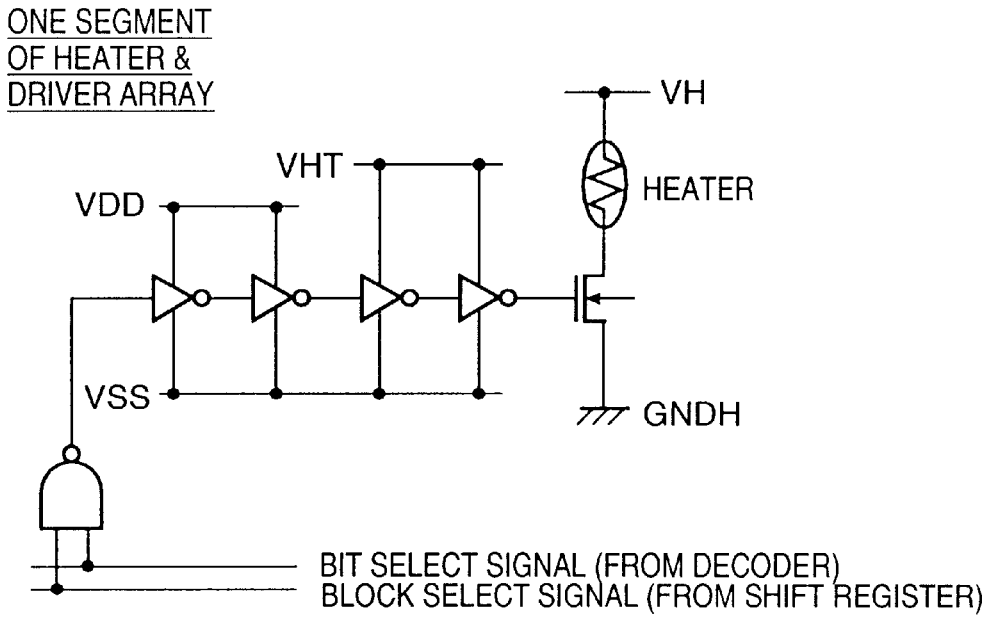
FIGS. 12A and 12B are equivalent circuit diagrams for explaining the embodiment of the present invention.
Figure 12B:
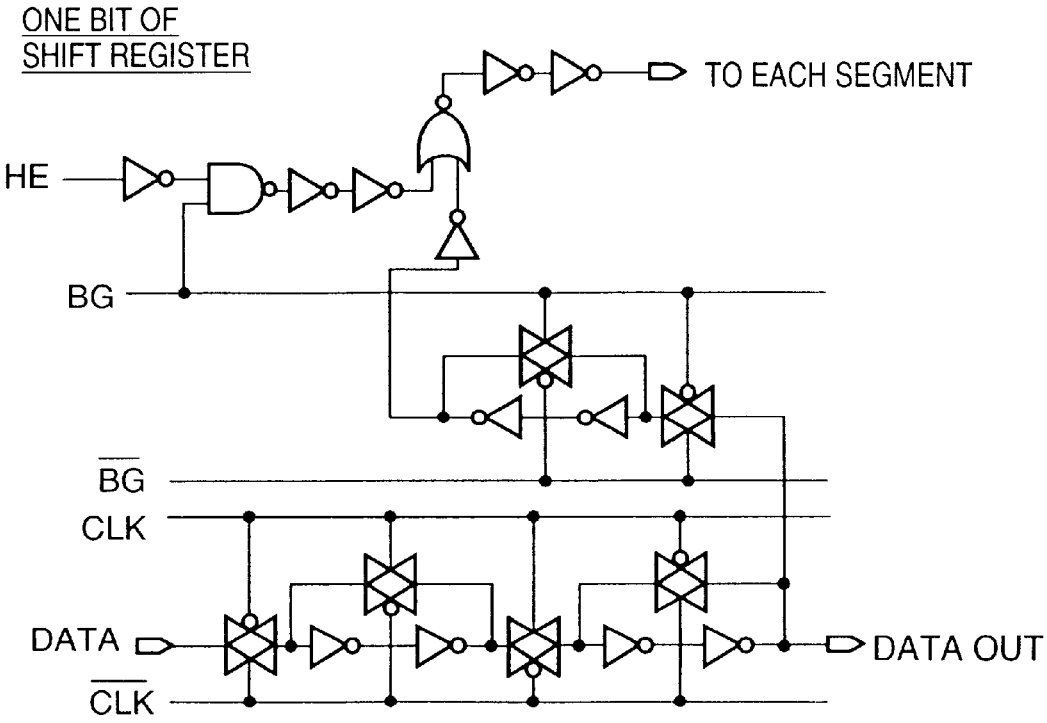
Figure 13:
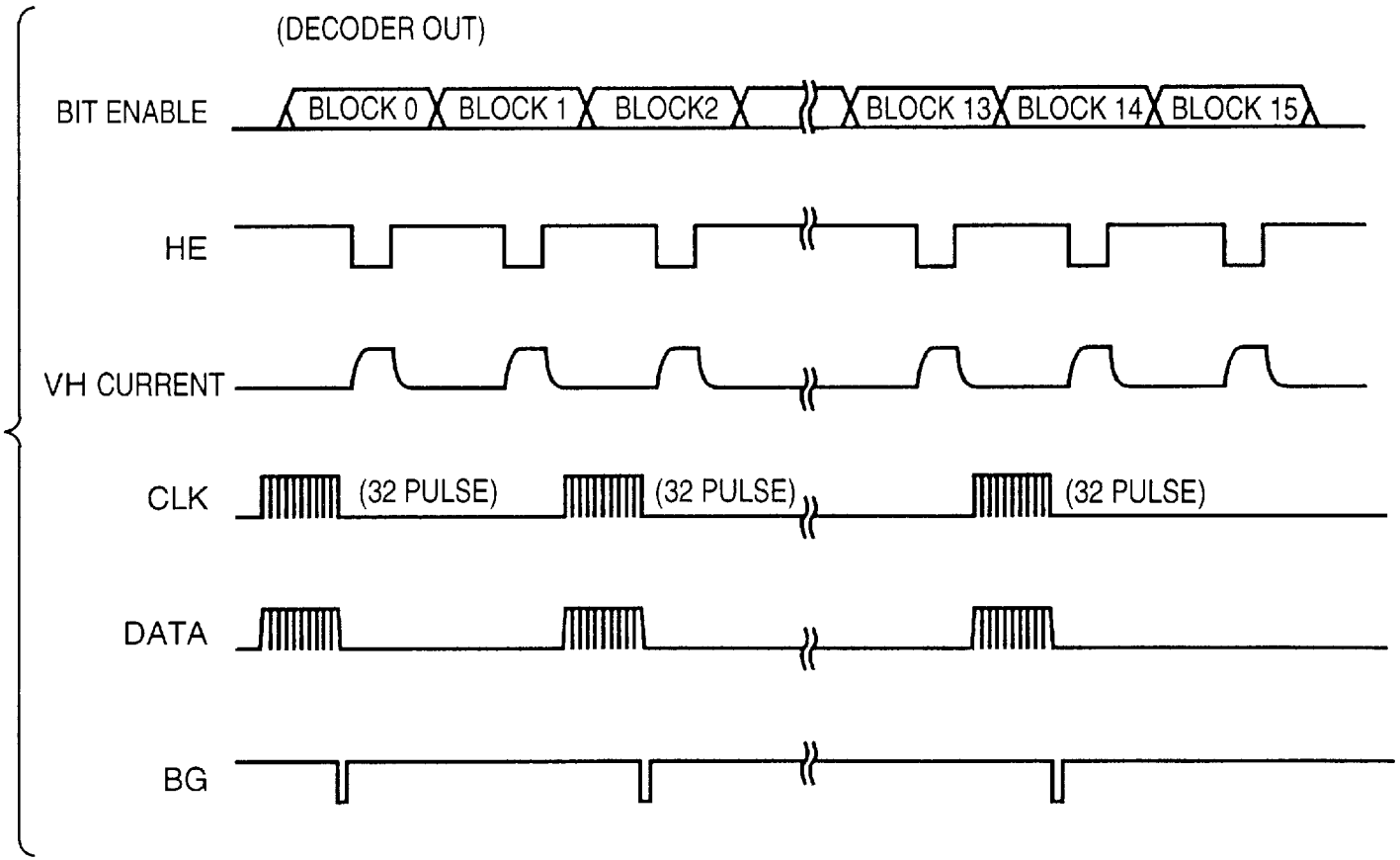
FIG. 13 is a timing chart for explaining the embodiment of the present invention.

FIG. 12A is an equivalent circuit diagram showing one segment of the driver & heater array 101, and FIG. 12B is an equivalent circuit diagram showing one bit of the shift register 103. FIG. 13 is a timing chart showing the signal states of respective units from the shift register to the heater. A series of operations from supply of printing information to the shift register to driving of the heater by flowing a current through it will be described with reference to FIGS. 12A, 12B, and 13.

Printing data is supplied to a DATA terminal in synchronism with a clock pulse applied to a CLK terminal. The printing data is temporarily stored in the shift register, and latched by a latch circuit in accordance with a latch signal applied to a BG terminal. A Block select signal for selecting heaters grouped into desired blocks and the printing data latched by the latch circuit are ANDed in a matrix manner, and a heater current flows in synchronism with an HE signal for directly determining the current driving time. The series of operations are repeated for blocks 0 to 15 to print data.

Figure 16:
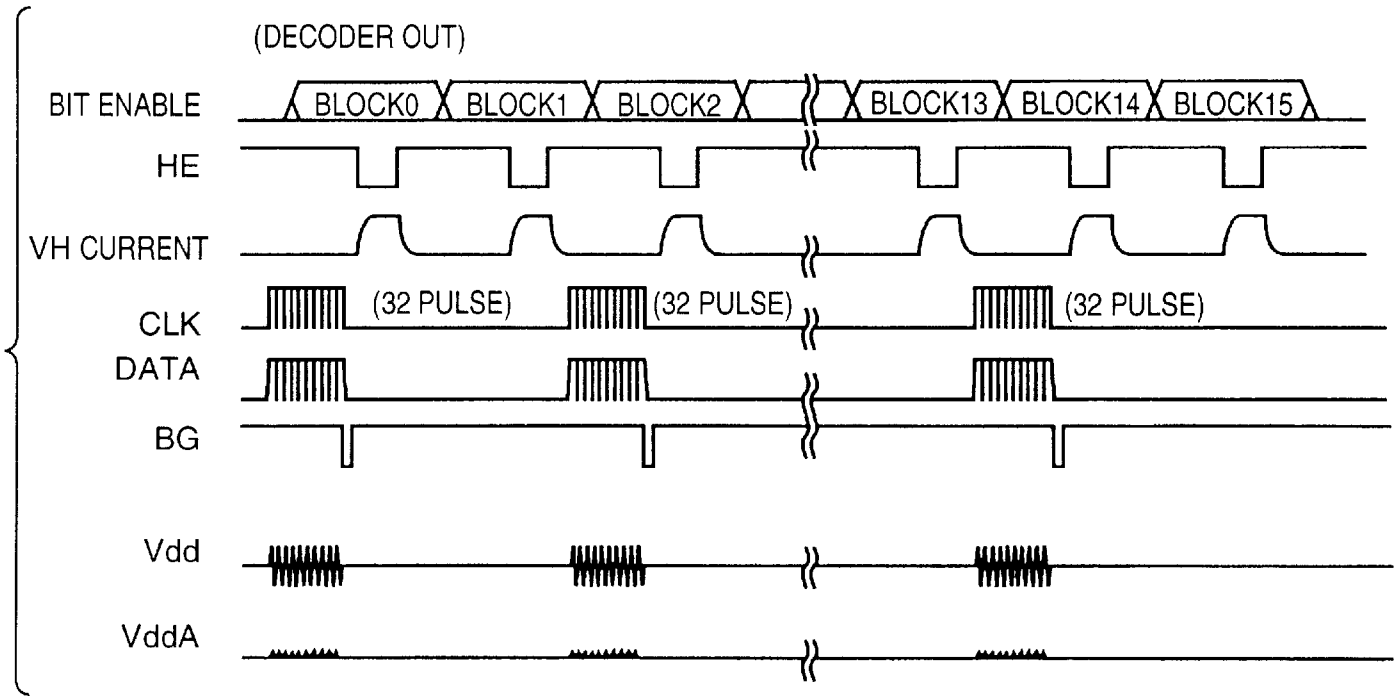
FIG. 16 is a timing chart for explaining the effects of the present invention.

The clock pulse frequency is as high as 1 MHz to 20 MHz. Noise of a high-frequency component as shown in FIG. 16 is mixed in synchronism with a clock pulse in the power supply terminal Vdd for supplying voltages to the input circuit 104 and shift register 103 connected to the clock pulse input terminal CLK.

Figure 14:
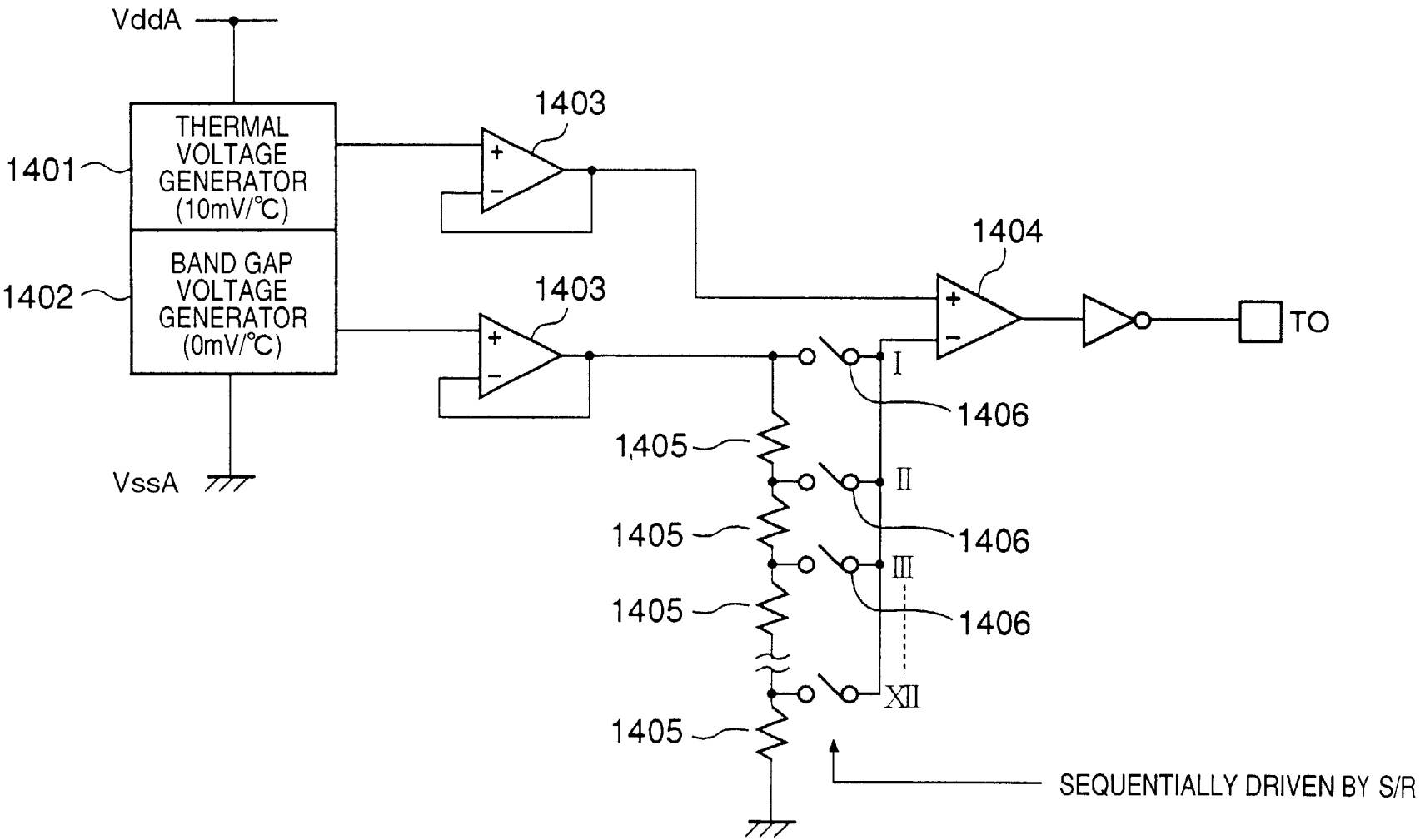
FIG. 14 is a block diagram (temperature sensing block) for explaining the contents of the embodiment of the present invention.
Figure 15:
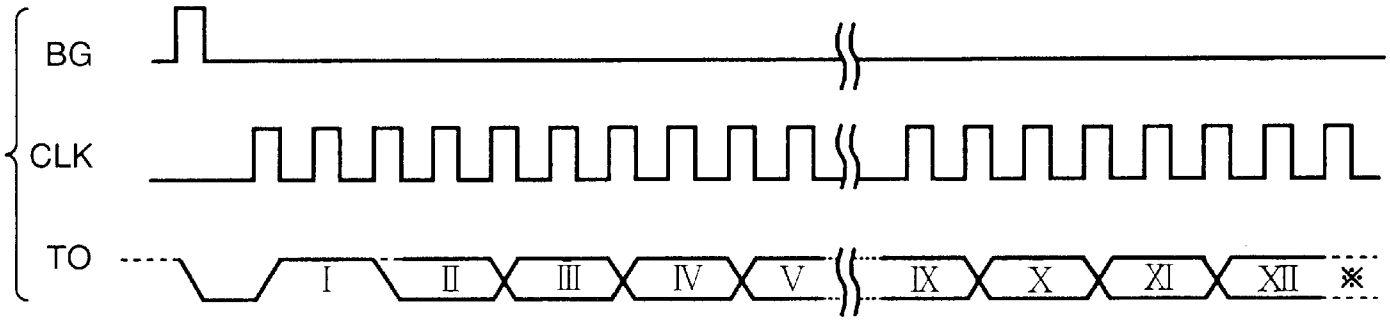
FIG. 15 is a timing chart showing the temperature sensing block in the embodiment of the present invention.

FIG. 14 is a block diagram showing the arrangement of the temperature sensing block 121 for sensing the temperature of the printing element board H1100, converting the information into a digital signal, and outputting the digital signal. FIG. 15 is a timing chart showing the signal states of the clock CLK and an output TO of the temperature sensing block 121. The operation of the temperature sensing block 121 will be explained with reference to FIGS. 14 and 15.

As shown in FIG. 14, the temperature sensing block 121 comprises a thermal voltage generator 1401 for generating a voltage having an almost linear characteristic with respect to the temperature, and a band gap voltage generator 1402 for generating an almost constant voltage with respect to the temperature. Outputs from these generators are passed through buffer circuits 1403, and compared by a comparator 1404 to output temperature information from the TO terminal.

At this time, an output from the band gap voltage generator 1402 is set to a voltage value corresponding to a temperature to be sensed at a division ratio using a plurality of resistors 1405. Switches 1406 connected to the division points between the resistors 1405 are sequentially switched by the shift register which operates in synchronism with a clock pulse, thereby obtaining digital information about a temperature at a desired resolution. In this embodiment, the thermal voltage generator 1401 generates a voltage having a temperature characteristic of 10 mV/° C., and voltages at the division points between the resistors 1405 are set at 12 points at an interval of 50 mV. Comparison results by the comparator 1404 for 12 temperatures at an interval of 5° C. are serially output from the TO terminal in synchronism with a clock signal. Hence, the same results as those attained when the comparison results of temperatures within the range of 60° C. compared at a resolution of 5° C. are digitally converted can be obtained.

Since the thermal voltage generator 1401 and band gap voltage generator 1402 process low voltages of about 10 mV, it is desirable to avoid mixture of noise generated by the clock in a power supply line extending from the power supply terminal VddA of the temperature sensing block 121.

In this embodiment, as shown in FIG. 11, the Vdd and VddA terminals are arranged apart from each other on the printing element board H1100 so as to prevent noise generated by a clock pulse from being mixed (transmitted) in the temperature sensing block 121 via the power supply terminal, and are laid out not to be adjacent to each other. Also on the wiring path in the printing element board H1100, these wires are arranged apart enough not to transmit noise, and laid out not to be adjacent to each other.

On the flexible cable 150 connecting the printing element board H1100 and electric printed circuit board H1300, thin wires are parallel-laid out over a relatively long distance (about several ten cm). Under great influence of the inductance component of the wire and the capacitance component between wires, noise of the digital system generated by a high-frequency clock pulse may mix in the signal of an analog system on the wires.

To suppress mixture of noise, this embodiment connects the capacitor 160 between a GND terminal and the short-circuited portion between the Vdd and VddA terminals on the electric printed circuit board H1300, as shown in FIG. 11. This suppresses mixtures of noise on the flexible cable 150 and electric printed circuit board H1300.

The inserted capacitor 160 desirably has frequency characteristics as high as possible in order to cut high-frequency noise, and the capacitance is preferably about 0.1 $\mu$F to 10 $\mu$F.

As described above, according to the embodiment, the terminal for receiving the power supply voltage of the analog circuit and the terminal for receiving the power supply voltage of the digital circuit are short-circuited near the external input terminal of the electrical circuit board of the printhead. Further, the bypass capacitor is added to the electrical circuit board. This arrangement can avoid mixture of noise of the digital circuit in the analog circuit, and decrease the noise level.

According to the embodiment, the power supply terminals of the analog and digital circuits are arranged apart enough not to transmit noise in the element board. This can suppress mixture of noise generated in the board.

The operation precision of an analog circuit such as a board temperature sensing circuit or heater resistance value monitoring circuit increases. The printing quality of the printhead can increase, and malfunction can be prevented, resulting in high performance.

Note that the embodiment has exemplified the printhead having two arrangements, i.e., the arrangement of the electrical circuit board in which the power supply voltage terminals of the analog and digital circuits are short-circuited, and the bypass capacitor is added, and the arrangement in which the power supplies of the analog and digital circuits are arranged apart from each other in the element board. However, the above-described effects can be achieved by either one of the arrangements.

The above-mentioned noise measure is effective particularly when the clock pulse frequency is 5 MHz or more.

This embodiment has exemplified the board temperature and heater resistance value as information to be sensed by the analog circuit. The information is not limited to them, and the above-described effects can also be expected for an analog circuit which processes the resistance value of the driver transistor, the individual value of the switching speed, the residual ink amount, or the thickness of the protective film.

Each of the embodiments described above has exemplified a printer, which comprises means (e.g., an electrothermal transducer, laser beam generator, and the like) for generating heat energy as energy utilized upon execution of ink discharge, and causes a change in state of an ink by the heat energy, among the ink-jet printers. According to this ink-jet printer and printing method, a high-density, high-precision printing operation can be attained.

As the typical arrangement and principle of the ink-jet printing system, those practiced by use of the basic principle disclosed in, for example, U.S. Pat. Nos. 4,723,129 and 4,740,796, are preferable. The above system is applicable to either one of so-called on-demand and continuous types. Particularly, in the case of the on-demand type, the system is effective because, by applying at least one driving signal, which corresponds to printing information and gives a rapid temperature rise exceeding nucleate boiling, to each of electrothermal transducers arranged in correspondence with a sheet or liquid channels holding a liquid (ink), heat energy is generated by the electrothermal transducer to effect film boiling on the heat acting surface of the printing head, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printing head, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region, is also included in the present invention. In addition, the present invention can be effectively applied to an arrangement based on Japanese Patent Laid-Open No. 59-123670 which discloses the arrangement using a slot common to a plurality of electrothermal transducers as a discharge portion of the electrothermal transducers, or Japanese Patent Laid-Open No. 59-138461 which discloses the arrangement having an opening for absorbing a pressure wave of heat energy in correspondence with a discharge portion.

Furthermore, as a full line type printing head having a length corresponding to the width of a maximum printing medium which can be printed by the printer, either the arrangement which satisfies the full-line length by combining a plurality of printing heads as disclosed in the above specification or the arrangement as a single printing head obtained by forming printing heads integrally can be used.

In addition, not only an exchangeable chip type printing head, as described in the above embodiment, which can be electrically connected to the apparatus main unit and can receive an ink from the apparatus main unit upon being mounted on the apparatus main unit, but also a cartridge type printing head in which an ink tank is integrally arranged on the printing head itself can be applicable to the present invention.

It is preferable to add recovery means for the printing head, preliminary auxiliary means, and the like provided as an arrangement of the printer of the present invention since the printing operation can be further stabilized. Examples of such means include, for the printing head, capping means, cleaning means, pressurization or suction means, and preliminary heating means using electrothermal transducers, another heating element, or a combination thereof. It is also effective for stable printing to provide a preliminary discharge mode which performs discharge independently of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printing head or by combining a plurality of printing heads.

Moreover, in each of the above-mentioned embodiments of the present invention, it is assumed that the ink is a liquid. Alternatively, the present invention may employ an ink which is solid at room temperature or less and softens or liquefies at room temperature, or an ink which liquefies upon application of a use printing signal, since it is a general practice to perform temperature control of the ink itself within a range from 30° C. to 70° C. in the ink-jet system, so that-the ink viscosity can fall within a stable discharge range.

In addition, in order to prevent a temperature rise caused by heat energy by positively utilizing it as energy for causing a change in state of the ink from a solid state to a liquid state, or to prevent evaporation of the ink, an ink which is solid in a non-use state and liquefies upon heating may be used. In any case, an ink which liquefies upon application of heat energy according to a printing signal and is discharged in a liquid state, an ink which begins to solidify when it reaches a printing medium, or the like, is applicable to the present invention.

In the present invention, the above-mentioned film boiling system is most effective for the above-mentioned inks.

The present invention can be applied to a system constituted by a plurality of devices (e.g., host computer, interface, reader, printer) or to an apparatus comprising a single device (e.g., copying machine, facsimile machine).

Further, the object of the present invention can also be achieved by providing a storage medium storing program codes for performing the aforesaid processes to a computer system or apparatus (e.g., a personal computer), reading the program codes, by a CPU or MPU of the computer system or apparatus, from the storage medium, then executing the program. In this case, the program codes read from the storage medium realize the functions according to the embodiments, and the storage medium storing the program codes constitutes the invention.

Further, the storage medium, such as a floppy disk, a hard disk, an optical disk, a magneto-optical disk, CD-ROM, CD-R, a magnetic tape, a non-volatile type memory card, and ROM can be used for providing the program codes.

Furthermore, besides the aforesaid functions according to the above embodiments being realized by executing the program codes which are read by a computer, the present invention includes a case where an OS (operating system) or the like working in the computer performs a part of or entire processes in accordance with designations of the program codes and realizes functions according to the above embodiments.

Furthermore, the present invention also includes a case where, after the program codes read from the storage medium are written in a function expansion card which is inserted into the computer or in a memory provided in a function expansion unit which is connected to the computer, a CPU or the like contained in the function expansion card or unit performs a part of or the entire process in accordance with designations of the program codes and realizes functions of the above embodiments.

In the case where the present invention is provided in the form of the above storage medium, the storage medium stores program codes corresponding to the above mentioned timing charts.

As many apparently widely different embodiments of the present invention can be made without departing from the spirit and scope thereof, it is to be understood that the invention is not limited to the specific embodiments thereof except as defined in the appended claims.

What is claimed is:

1. A printhead comprising:

an element substrate on which a digital circuit including a printing element and driving means for driving the printing element in accordance with input printing data, and an analog circuit including sensing means for sensing information about a state of said element substrate are formed by a semiconductor process; and an electrical circuit substrate which is connected to said element substrate, and has a plurality of external input terminals for inputting/outputting signals from/to said element substrate, wherein a power supply of said digital circuit and a power supply of said analog circuit are commonly connected to one terminal of a capacitor provided on said electrical circuit substrate with the other terminal grounded on said electrical circuit substrate.

2. The printhead according to claim 1, wherein the power supply of said digital circuit and the power supply of said analog circuit are arranged sufficiently apart so as not to transmit influence of noise on said element substrate.

3. The printhead according to claim 1, wherein said digital curcuit includes a shift register for temporarilly storing the printing data and a latch for latching the data stored in said shift register.

4. The printhead according to claim 1, wherein said analog curcuit includes either one of means for sensing a temperature outside said element substrate and means for monitoring a heater resistance value.

5. The printhead according to claim 1, wherein the printhead is an inkjet printhead for discharging ink to perform printing.

6. The printhead according to claim 5, wherein the printing element comprises a thermal energy transducer for generating thermal energy to be applied to ink in order to discharge the ink.

7. The printhead according to claim 6, wherein said sensing means senses a temperature of said element substrate.

8. The printhead according to claim 6, wherein said digital circuit includes a memory for storing at least one of items of information about a resistance value of the thermal energy transducer, a resistance value in operating the driving means, and a thickness of each layer constituting said element substrate.

9. The printhead according to claim 1, wherein said capacitor has a capacitance of not less than 0.1 $\mu$F.

10.The printhead according to claim 9, wherein said capacitor has a capacitance of not more than 10 $\mu$F.

11. A printing apparatus comprising:

an element substrate on which a digital circuit including a printing element and driving means for driving the printing element in accordance with input printing data, and an analog circuit including sensing means for sensing information about a state of said element substrate are formed by a semiconductor process; and an electrical circuit substrate which is connected to said element substrate, and has a plurality of external input terminals for inputting/outputting signals from/to said element substrate, wherein a power supply of said digital circuit and a power supply of said analog circuit are commonly connected to one terminal of a capacitor provided on said electrical circuit substrate with the other terminal grounded on said electrical circuit substrate.

12. The apparatus according to claim 11, wherein the power supply of said digital circuit and the power supply of said analog circuit are arranged sufficiently apart so as not to transmit influence of noise on said element substrate.

* * * * *